US007144668B2

(12) United States Patent
Baba et al.

(10) Patent No.: US 7,144,668 B2
(45) **Date of Patent: *Dec. 5, 2006**

(54) TONER AND TWO-COMPONENT DEVELOPER

(75) Inventors: Yoshinobu Baba, Kanagawa (JP); Yuko Sato, Shizuoka (JP); Ryoichi Fujita, Tokyo (JP); Takaaki Kotaki, Shizuoka (JP); Nobuyoshi Sugahara, Shizuoka (JP); Kazuo Terauchi, Shizuoka (JP); Takayuki Itakura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 221 days.

This patent is subject to a terminal disclaimer.

(21) Appl. No.: 10/792,732

(22) Filed: Mar. 5, 2004

(65) Prior Publication Data

US 2004/0175643 A1 Sep. 9, 2004

(30) Foreign Application Priority Data

Mar. 7, 2003 (JP) ..... 2003-061823

(51) Int. Cl.
*G03G 9/087* (2006.01)

(52) U.S. Cl. ..... 430/109.4; 430/111.4; 430/110.4; 430/111.31; 430/111.35

(58) Field of Classification Search ..... 430/110.4, 430/109.4, 111.4, 111.31, 111.35
See application file for complete search history.

(56) References Cited

U.S. PATENT DOCUMENTS

| | | | | |
|---|---|---|---|---|
| 5,635,325 | A | 6/1997 | Inaba et al. | 430/106 |
| 5,712,069 | A | 1/1998 | Baba et al. | 430/106.6 |
| 5,915,150 | A * | 6/1999 | Kukimoto et al. | 430/110.4 |
| 6,077,635 | A | 6/2000 | Okada et al. | 430/45 |
| 6,100,000 | A | 8/2000 | Anno et al. | 430/106.6 |
| 6,436,599 | B1 | 8/2002 | Matsuoka et al. | 430/137.19 |
| 6,613,490 | B1 * | 9/2003 | Matsunaga et al. | 430/111.4 |
| 2003/0039908 | A1 * | 2/2003 | Hiratsuka et al. | 430/110.4 |
| 2003/0125479 | A1 | 7/2003 | Kinsho et al. | 525/403 |
| 2004/0175642 | A1 * | 9/2004 | Ida et al. | 430/111.4 |
| 2005/0079429 | A1 * | 4/2005 | Hayami et al. | 430/109.4 |

FOREIGN PATENT DOCUMENTS

| | | |
|---|---|---|
| EP | 1241530 | 9/2002 |
| EP | 1249735 A2 * | 10/2002 |
| EP | 1283236 | 2/2003 |
| JP | 7-181732 | 7/1995 |
| JP | 8-50368 | 2/1996 |
| JP | 8-314300 | 11/1996 |
| JP | 11-44969 | 2/1999 |
| JP | 2000-3075 | 1/2000 |

OTHER PUBLICATIONS

Diamond, Arthur S & David Weiss (eds.) Handbook of Imaging Materials. New York: Marcel-Dekker, Inc. (Nov. 2001) pp. 155-159 & 209-234.*

* cited by examiner

*Primary Examiner*—Christopher RoDee
(74) *Attorney, Agent, or Firm*—Fitzpatrick, Cella, Harper & Scinto

(57) ABSTRACT

The present invention provides a toner: comprising a binder resin comprising a polyester unit, a colorant, a releasing agent, and inorganic fine particles; has a weight average particle diameter of 3.0–6.5 μm; has an average circularity of particles in the toner each having a circle-equivalent diameter of 2 μm or more of 0.920–0.945; has a BET specific surface area of 2.1–3.5 $m^2/g$; and has a permeability of light of a wavelength of 600 nm in a liquid having dispersed the toner in a 45 vol % methanol aq. of 30–80%. The present invention also provides a two-component developer: comprising the toner and a magnetic carrier comprising magnetic core particles coated by a coating layer; and has a number average particle diameter of 15–80 μm. Using the toner and the two-component developer enables a high-quality image to be formed at a high speed even in an oilless fixing system.

17 Claims, 4 Drawing Sheets

TONER AND TWO-COMPONENT DEVELOPER

This application claims the right of priority under 35 U.S.C. §119 based on Japanese Patent Application No. JP 2003-061823 which is hereby incorporated by reference herein in its entirety as if fully set forth herein.

BACKGROUND OF THE INVENTION

1. Field of the Invention

The present invention relates to a toner for use in electrophotography, electrostatic printing, or a toner jet recording method, and a two-component developer comprising the toner.

2. Description of the Related Art

The following methods have been generally used in recent years in proposed full-color copying machines and full-color printers. One method is a method for forming a full-color image, the method including: using four photosensitive members and a belt-shaped transfer body; developing an electrostatic charge image formed on each photosensitive member with a cyan toner, a magenta toner, a yellow toner, and a black toner severally; and sequentially transferring a toner image onto the photosensitive member while transporting a transfer material to a position between the photosensitive member and the belt-shaped transfer body. Another method includes: winding a transfer material on the surface of a transfer body that is opposed to a photosensitive member by an electrostatic force or a mechanical action such as that of a gripper; and performing a step of developing and a step of transferring four times to obtain a full-color image.

Toners to be loaded into those full-color copying machines and full-color printers require an improvement in color reproducibility and sufficient color mixing of the respective toners during a step of heat and pressure fixing without impairment of transparency of an overhead projector (OHP) image.

Moreover, a toner has been recently required to have functions that allow adaptation to high speed processing and to on-demand printing. In addition, the toner is required to achieve improved better low temperature fixability, expansion of a non-offset area, and control of a gloss.

In the conventional method, in order to achieve the above-described objects, a fixing member has been generally used with applying silicone oil to the surface of a fixing member. However, the conventional method involves contamination in a machine due to vaporization of the silicone oil and the difficulty in achieving evenness of application. Thus, enhanced releasability has been recently imparted to a toner.

JP 08-314300 A and JP 08-050368 A each propose a toner produced by encapsulating wax in a toner particle via suspension polymerization, and an image forming method in which the toner is used so that no silicone oil is used.

Although each of those toners suppresses an oil streak on a fixed image, each of those toners requires encapsulation of a large amount of wax in a toner particle, and uses a binder mainly composed of a styrene-acrylic resin. As a result, irregularities on the surface of the fixed image may become a problem. Therefore, a further improvement in OHP permeability has been demanded.

Because image recorded articles made by those toners have low glosses, there is a merit that a satisfactory image with no sense of incongruity can be obtained in a graphic image in which a graph and a character portion mix.

However, in a pictorial image, the toner is not sufficiently melted when the toner is fixed, and thus there is a demerit that the color-mixing property of a secondary color is low to result in a narrow color reproduction range.

In view of the above, a toner has been awaited, which is excellent in low temperature fixability, which achieves gloss control, which is excellent in color-mixing property, which provides a wide color reproduction range, and which is excellent in OHP permeability when a heat and pressure fixing means is used in which no oil is used or oil usage is reduced. As a method of achieving such a toner, an attempt has been made to employ polyester having a high sharp melt property as a main binder.

Furthermore, from the viewpoint of realizing print on demand, the need for dealing with various materials including cardboard and coat paper arises, so that a transfer method using an intermediate transfer body has been becoming increasingly effective. A toner is developed onto a photosensitive member, and is then temporarily transferred onto an intermediate transfer body. After that, the toner is transferred onto a transfer material. Therefore, a toner having higher transfer efficiency is desired.

Known as such a toner is a toner which is excellent in developability and transferability, which provides satisfactory offset resistance in an oilless fixing system, and which is excellent in OHP permeability.

JP 11-044969 A proposes a sphered toner produced by: using a linear polyester resin or a non-linear polyester resin; dispersing the polyester resin, a colorant, and a releasing agent in an organic solvent in which the resin dissolves; dispersing the resultant liquid in an aqueous medium for granulation; and removing the organic solvent under reduced pressure in this state. The toner obtained exhibits extremely high transferability, and is excellent in hot offset resistance.

However, the toner involves the difficulty in adjusting particle diameters of toner particles of 5 μm or less, and in the toner, improved low temperature fixability is required for further high speed processing.

JP 07-181732 A proposes, as a method of producing such a toner, a method in which a toner comprising a colorant and a releasing agent, the toner is sphered with a mechanical impact force to enhance transfer efficiency. Examples of a known apparatus for speroidization with a mechanical impact force include Hybridization System manufactured by Nara Machinery Co., Ltd., Mechanofusion System manufactured by Hosokawa Micron Corp., and Cryptron System manufactured by Kawasaki Heavy Industries, Ltd.

However, each of those systems is a system that applies a mechanical impact force during pulverization of a toner, although those systems differ from one another in degree of pulverization. Therefore, exudation of a releasing agent due to the appearance of a new surface simultaneously with sphering tends to occur, so that developability may decrease. In particular, in the case where the releasing agent is poorly dispersed, the exudation of the releasing agent becomes remarkable.

In addition, a reduction in toner particle diameter has been carried out to improve dot reproducibility and fine line reproducibility. However, in a toner which provides low temperature fixability and hot offset resistance, and which comprises a polyester resin and a releasing agent as described above to obtain a high gloss, a reduction in toner particle diameter results in an abrupt increase in toner specific surface area. Therefore, it has been difficult to prevent both the exudation of the releasing agent upon heat and pressure fixing and the exudation of the releasing agent due to the stress applied to the toner upon impartment of frictional electrification in development.

JP 2000-003075 A proposes sphering and uniformizing shapes of particles in a developer (a toner or a toner and a magnetic carrier) obtained by a kneading-pulverization method to thereby uniformize charge.

Sphering of the toner mitigates scattering and improves transferability. However, a toner sphered through hot air treatment makes it difficult to control the state of existence of a releasing agent (hereinafter, referred to as "releasing-agent existence state") near the toner surface, thereby making it difficult to satisfy low temperature fixability and developability at the same time.

SUMMARY OF THE INVENTION

An object of the present invention is to provide a toner that has solved the above-described problems, and a two-component developer comprising the toner.

Another object of the present invention is to provide a toner that is excellent in transferability, dot reproducibility, and fine line reproducibility, and a two-component developer comprising the toner.

Another object of the present invention is to provide a toner that can be fixed with no application of a large amount of oil or with no application of oil, and a two-component developer comprising the toner.

Another object of the present invention is to provide a toner that is excellent in low temperature fixability and hot offset resistance, and a two-component developer comprising the toner.

Another object of the present invention is to provide a toner that can achieve a high gloss even in high-speed printing, and a two-component developer comprising the toner.

Another object of the present invention is to provide a toner comprising toner particles each comprising at least a binder resin, a colorant, and a releasing agent, and inorganic fine particles, wherein:

the binder resin comprises at least a polyester unit;

a weight average particle diameter of the toner is in a range of 3.0 to 6.5 μm;

an average circularity of particles in the toner each having a circle-equivalent diameter of 2 μm or more is in a range of 0.920 to 0.945;

a BET specific surface area of the toner is in a range of 2.1 to 3.5 $m^2/g$; and a permeability of light of a wavelength of 600 nm in a liquid prepared by dispersing the toner in a 45 vol % aqueous solution of methanol is in a range of 30 to 80%.

Another object of the present invention is to provide a two-component developer comprising a toner and a magnetic carrier, wherein:

the toner comprises toner particles each comprising at least a binder resin, a colorant, and a releasing agent, and inorganic fine particles;

the binder resin comprises at least a polyester unit;

a weight average particle diameter of the toner is in a range of 3.0 to 6.5 μm;

an average circularity of particles in the toner each having a circle-equivalent diameter of 2 μm or more is in a range of 0.920 to 0.945;

a BET specific surface area of the toner is in a range of 2.1 to 3.5 $m^2/g$;

a permeability of light of a wavelength of 600 nm in a liquid prepared by dispersing the toner in a 45 vol % aqueous solution of methanol is in a range of 30 to 80%; and the magnetic carrier comprises: magnetic core particles comprising a magnetic material; and a coating layer formed on surfaces of the magnetic core particles by using a resin, and a number average particle diameter of the magnetic carrier is in a range of 15 to 80 μm.

DESCRIPTION OF THE PREFERRED EMBODIMENTS

Figure 1:
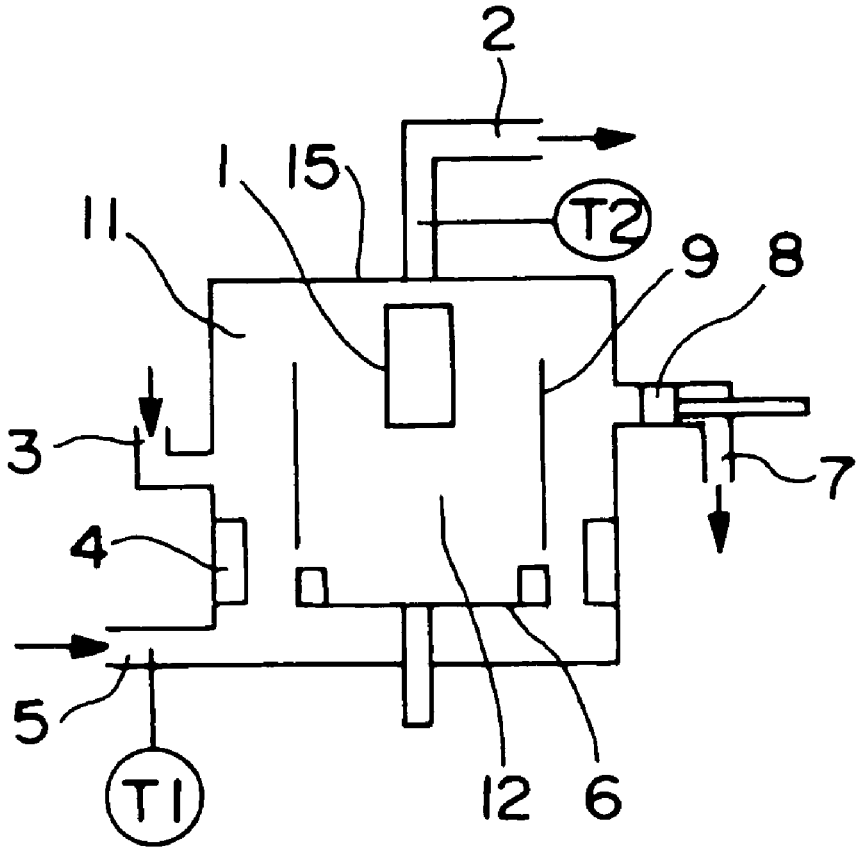
FIG. 1 is a schematic sectional view showing a structure of an example of a surface modifying apparatus to be used in a step of surface modifying when producing a toner of the present invention.

The inventors of the present invention have found out the following. When fine powder with a large specific surface area is discharged to the outside of a system applying a mechanical impact force, the fine powder is obtained by applying the mechanical impact force to a fine particles produced by a step of pulverizing in a kneading-pulverization method with discharging the fine particles to the outside of a system for the method, a larger quantity of heat than is necessary is not applied to toner particles, and the toner particles can be classified simultaneously with repeated sphering of the toner particles. Thus, desired toner particle shapes, desired toner shapes, and the releasing-agent existence state near the toner particle surface can be controlled. The inventors have achieved the present invention on the basis of the above-described finding.

A weight average particle diameter of the toner of the present invention is in the range of 3.0 to 6.5 μm. Furthermore, the weight average particle diameter of the toner is preferably in the range of 4.0 to 6.0 μm for sufficiently satisfying dot reproducibility and transfer efficiency. A weight average particle diameter of the toner of less than 3.0 μm leads to a reduction in toner particle yield upon sphering, an increase in specific surface area of the toner particle and the toner. As a result, it becomes difficult to uniformly control the releasing-agent existence state, so that low temperature fixability and developability may not be mutually compatible. A weight average particle diameter of the toner of more than 6.5 μm makes toner scattering be visually perceived to thereby result in a reduction in dot reproducibility in the case where a spot of an electrostatic latent image has a very small spot diameter of 600 dpi or more. The weight average particle diameter of the toner can be adjusted by classification of toner particles upon production.

In the present invention, an average circularity of particles in the toner each having a circle-equivalent diameter of 2 μm or more is 0.920 or more and 0.945 or less. Furthermore, the average circularity of the toner is preferably in the range of 0.925 to 0.940 from the viewpoint of compatibility between transferability and developability. An average circularity of the toner of less than 0.920 results in insufficient sphering. In this case, the existence of a releasing agent is insufficiently controlled, so that low temperature fixability may be somewhat inferior or transfer efficiency may decrease.

An average circularity of the toner of more than 0.945 reduces developability to result in a reduction in transferability after prolonged use, although the average circularity considerably improves transfer efficiency at an early stage. This is probably attributed to the exudation of the releasing agent caused by sphering extend over a long period of time. The average circularity of the toner can be adjusted by a method for producing a toner particle or a sphering method by applying a mechanical force or heat to a toner particle.

A permeability of light of a wavelength of 600 nm in a liquid prepared by dispersing the toner of the present invention in a 45 vol % aqueous solution of methanol is in the range of 30 to 80%. Furthermore, the permeability is preferably in the range of 40 to 65% for ensuring compatibility between excellent low temperature fixability and developability in case of using a toner having a weight average particle diameter of 3.0 to 6.5 μm in a high-speed machine with a high process speed, and for forming an image with a high gloss.

A binder resin and a releasing agent are different from each other in wettability. Therefore, in the case where a toner is dispersed in a water-methanol solution, the concentration of the water-methanol solution in which the toner is dispersed differs depending on the difference in releasing-agent existence state near the toner particle surface. In the present invention, by taking advantage of the property, the permeability is measured and used as an indicator for the releasing-agent existence state near the toner particle surface. In addition, sensitivity to the difference in wettability between the binder resin and the releasing agent becomes satisfactory when an aqueous solution of methanol the methanol concentration of which is in the vicinity of 45 vol % is used. Therefore, in the present invention, a 45 vol % aqueous solution of methanol (45 vol % methanol+55 vol % water) is used.

The permeability of the toner in a 45 vol % aqueous solution of methanol may have a large value owing to an increase in toner surface area with decreasing toner particle diameter. In particular, in a toner having such a small particle diameter as in the range of 3.0 to 6.5 μm like the present invention, the surface property of the toner surface becomes susceptible to the dispersion state and dispersion particle diameter of a releasing agent. Therefore, even a slight dispersion failure changes the permeability to a large extent. The permeability increases in the case where a large amount of releasing agent is present near the toner particle surface or in the case where the dispersion state of a releasing agent is poor and the top of a mass of releasing agent appears onto the toner particle surface. This is probably because, in each of the above-described cases, toner wettability with respect to the water-methanol solution becomes poor, so that the toner is hardly dispersed.

A permeability of less than 30% provides a small existing amount of the releasing agent near the toner particle surface and extremely satisfactory developability after prolonged use, but may reduce low temperature fixability and a gloss. A permeability of more than 80% provides satisfactory low temperature fixability, but causes to liberate the releasing agent from the toner. The liberated releasing agent shifts to the surface of a developing sleeve or of a magnetic carrier to contaminate the surface, so that developability may decrease over prolonged use.

JP 2000-003075 A discloses a toner produced by: mixing two kinds of polyester resins, a polyethylene wax, a polypropylene wax, carbon black, and a charge control agent in Henschell Mixer; kneading the mixture in a biaxial extruding kneader; cooling the kneaded product; roughly pulverizing the kneaded product with a hammer mill; finely pulverizing the roughly pulverized products with a jet pulverizer; mixing the resultant toner particles with hydrophobic silica fine powder; sphering the particle mixture at 270° C. with a surface modifying apparatus in a state where the hydrophobic silica fine powder is added to the toner particle surface; classifying the sphered product; and externally adding hydrophobic silica fine powder and strontium titanate particles to the classified products. Although the toner disclosed in JP 2000-003075 A provides an extremely high average circularity of 0.953, the measured permeability of the toner in a 45 vol % aqueous solution of methanol is 83%.

The above toner increases the amount of exudation of wax, and provides relatively satisfactory developability at an early stage because the toner has a large amount of external additives. However, when the above toner is used in a high-speed machine, the developability gradually diminishes as the toner is subjected to a stress.

Further, a toner produced by: mixing a polyester resin, a pigment, and a low molecular weight polypropylene wax in Henschell Mixer; kneading the mixture in a biaxial extruding kneader; cooling the kneaded product; roughly pulverizing the kneaded product with a hammer mill; finely pulverizing the roughly pulverized products with a jet pulverizer; classifying the finely pulverized products with a multi-division classifier; and externally adding hydrophobic silica fine powder to the classified products. This toner provides an average circularity as low as 0.913, and the measured permeability of this toner in a 45 vol % aqueous solution of methanol is 3%.

The above toner decreases the existing amount of wax on the toner particle surface because the low molecular weight polypropylene wax is rigid. Therefore, the developability can be stabilized over prolonged use, but the amount of exudation of the releasing agent (wax) is low upon fixing, thereby resulting in reduced low temperature fixability.

The permeability can be adjusted by controlling the releasing-agent existence state on the toner particle surface through control of various conditions including: the temperature and time period for the pulverization and shape adjustment of toner particles upon their production; the kind of releasing agent to be used; and the kind of dispersant for the releasing agent. The permeability can be measured with a spectrophotometer.

Inorganic fine particles are externally added to the toner of the present invention for improving flowability and transferability, in particular transfer efficiency. One example of external additives to be externally added to the toner particle surface is preferably an inorganic fine particle, which is at least one of a titanium oxide fine particle, an alumina oxide fine particle, and a silica fine particle, and a main peak particle diameter of the inorganic fine particles is preferably in the range of 80 to 200 nm in order to allow the inorganic fine particles to function as spacer particles to transfer the toner, and to develop satisfactorily with a toner having a small particle diameter. In addition, the external additive is preferably used in combination with fine particles having a main peak particle diameter, which is in a particle size distribution based on the number, of 70 nm or less for improving flowability of the toner.

ABET specific surface area of the toner of the present invention is in the range of 2.1 to 3.5 $m^2/g$. Furthermore, the BET specific surface area of the toner is preferably in the range of 2.5 to 3.2 $m^2/g$ for achieving maintenance of developability after prolonged use, maintenance of transfer efficiency, and excellent low temperature fixability.

A BET specific surface area of the toner of less than 2.1 $m^2/g$ provides satisfactory low temperature fixability, but may reduce developability upon prolonged use. In addition, with such a BET specific surface area, the transfer efficiency slightly decreases as well. A BET specific surface area of the toner of more than 3.5 $m^2/g$ provides sufficiently high transfer efficiency, but may result in reduced image quality or low temperature fixability due to scattering. The BET specific surface area of the toner can be adjusted by externally adding an appropriate amount of inorganic fine particles having appropriate particle diameters or inorganic fine particles having appropriate BET specific surface areas.

According to the present invention, there is provided a toner having toner particles each comprising a binder resin, a colorant, and a releasing agent, and inorganic fine particles, in which the binder resin comprises a polyester unit when the toner is used in oilless fixing, the toner has a small particle diameter in the range of 3.0 to 6.5 μm, the toner is appropriately sphered, external additives including the inorganic fine particles are externally added to the toner particles, the toner has an appropriate BET specific surface area, and a releasing-agent existence state at the toner particle surface is controlled. With the above toner, transferability, and therefore dot reproducibility and fine line reproducibility can be improved. At the same time, excellent low temperature fixability and excellent hot offset resistance can be achieved, and developability can be satisfactorily maintained over prolonged use in a high-speed machine.

The binder resin to be used in the toner of the present invention is a resin selected from the group consisting of: (a) a polyester resin; (b) a hybrid resin comprising a polyester unit and a vinyl-based polymer unit; (c) a mixture of a hybrid resin and a vinyl-based polymer; (d) a mixture of a polyester resin and a vinyl-based polymer; (e) a mixture of a hybrid resin and a polyester resin; and (f) a mixture of a polyester resin, a hybrid resin, and a vinyl-based polymer.

In the present invention, the term "polyester unit" refers to a part derived from polyester, and the term "vinyl-based polymer unit" refers to a part derived from a vinyl-based polymer. Examples of polyester-based monomers constituting the polyester unit include a polyvalent carboxylic acid component and a polyhydric alcohol component. A vinyl-based monomer is defined as a monomer component having a vinyl group. A monomer having multiple carboxyl groups and vinyl groups in the monomer, or a monomer having multiple OH groups and vinyl groups in the monomer is defined as the polyester based monomer. A preferable polyester unit content in a binder is 50 mass % or more to render low temperature fixability satisfactory.

A molecular weight distribution of the toner of the present invention measured by gel permeation chromatography (GPC) of a resin component has a main peak in the molecular weight range of 3,500 to 30,000, preferably in the molecular weight range of 5,000 to 20,000. In addition, a ratio Mw/Mn of a weight average molecular weight to a number average molecular weight is preferably 5.0 or more.

The presence of a main peak in the molecular weight range below 3,500 reduces hot offset resistance of the toner. On the other hand, the presence of a main peak in the molecular weight range above 30,000 reduces low temperature fixability, thereby making it difficult to apply the toner to a high-speed machine. Moreover, if Mw/Mn is less than 5.0, the toner exhibits a sharp melt property, so that a high gloss is achieved more easily. However, hot offset resistance decreases.

In a monomer comprising the polyester resin or the polyester unit comprised the binder resin used the toner of the present invention, a polyhydric alcohol and a carboxylic acid component such as a polyvalent carboxylic acid, a polyvalent carboxylic anhydride, or a polyvalent carboxylic ester having two or more carboxyl groups can be used as a material monomer.

Concretely, examples of a bivalent alcohol component include: alkylene oxide adducts of a bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, bisphenol A, and hydrogenated bisphenol A.

Examples of a trivalent or more-valued alcohol component include sorbitol, 1,2,3,6-hexane tetrol, 1,4-sorbitan, pentaerythritol, dipentaerythritol, tripentaerythritol, 1,2,4-butanetriol, 1,2,5-pentanetriol, glycerol, 2-methylpropane triol, 2-methyl-1,2,4-butanetriol, trimethylol ethane, trimethylol propane, and 1,3,5-trihydroxymethyl benzene.

Examples of a carboxylic acid component include: aromatic dicarboxylic acids such as a phthalic acid, isophthalic acid, and terephthalic acid or an anhydride thereof; alkyl dicarboxylic acids such as a succinic acid, adipic acid, sebacic acid, and azelaic acid or an anhydride thereof; a succinic acid substituted by an alkyl group having 6 to 12 carbon atoms, or an anhydride thereof; unsaturated dicarboxylic acids such as a fumaric acid, maleic acid, and citraconic acid, or an anhydride thereof.

The polyester resin or the polyester unit particularly employs, as an alcohol component, a bisphenol derivative typified by the following formula (1)

(1)

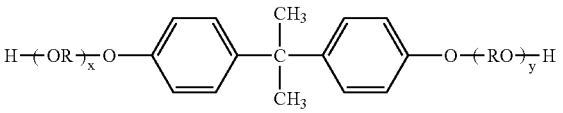

(In the formula, R denotes one or more chosen from an ethylene group and a propylene group, x and y each denote an integer of 1 or more, and an average value of x+y is 2 to 10.) and, as an acid component, a carboxylic acid with a valence of 2 or more or an anhydride of the carboxylic acid, or a carboxylic acid component composed of a lower alkyl ester of the carboxylic acid (for example, fumaric acid, maleic acid, maleic anhydride, phthalic acid, terephthalic acid, trimellitic acid, or pyromellitic acid). Apolyester resin prepared by condensation polymerization of those components is preferable because of its satisfactory charging property as a toner.

Examples of a trivalent or more-valued carboxylic acid component for forming a polyester resin having a crosslinking site include 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, or anhydrides and ester compounds thereof.

The amount of the trivalent or more-valued carboxylic acid component to be used is preferably 0.1 to 1.9 mol % based on the amount of total monomers.

Moreover, in the present invention, further improved releasing agent dispersibility and enhanced low temperature fixability and offset resistance can be expected from the use of a hybrid resin comprising a polyester unit and a vinyl-based polymer unit as the binder resin. The term "hybrid resin component" as used in the present invention refers to a resin in which a vinyl-based polymer unit and a polyester unit are chemically bonded to each other. Specifically, a polyester unit and a vinyl-based polymer unit obtained by polymerizing a monomer having a carboxylate group such as a (meth)acrylate form a hybrid resin component through an ester exchange reaction. Preferably, the polyester unit and the vinyl-based polymer form a graft copolymer (or a block copolymer) in which the vinyl-based polymer serves as a backbone polymer and the polyester unit serves as a branch polymer.

Examples of a vinyl-based monomer for producing the vinyl-based polymer or the vinyl-based unit include: styrene; styrene derivatives such as o-methyl styrene, m-methyl styrene, p-methyl styrene, α-methyl styrene, p-phenyl styrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, p-chlorostyrene, 3,4-dichlorostyrene, m-nitrostyrene, o-nitrostyrene, and p-nitrostyrene; unsaturated mono-olefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic mono-carboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethyl amino ethyl methacrylate, and diethyl amino ethyl methacrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinyl pyrrole, N-vinyl carbazole, N-vinyl indole, and N-vinyl pyrrolidone; vinyl naphthalenes; and acrylic derivatives or methacrylic derivatives such as acrylonitrile, methacrylonitrile, and acrylamide.

Furthermore, there are included: unsaturated dibasic acids such as maleic acid, citraconic acid, itaconic acid, alkenyl succinic acid, fumaric acid, and mesaconic acid; anhydrides of unsaturated dibasic acids such as maleic anhydride, citraconic anhydride, itaconic anhydride, and alkenyl succinic anhydride; half esters of unsaturated dibasic acids such as maleic methyl half ester, maleic ethyl half ester, maleic butyl half ester, citraconic methyl half ester, citraconic ethyl half ester, citraconic butyl half ester, itaconic methyl half ester, alkenyl succinic methyl half ester, fumaric methyl half ester, and mesaconic methyl half ester; esters of unsaturated dibasic acids such as dimethyl maleate and dimethyl fumarate; α, β-unsaturated acids such as acrylic acid, methacrylic acid, crotonic acid, and cinnamic acid; α, β-unsaturated acid anhydrides such as crotonic anhydride and cinnamic anhydride; anhydrides of α, β-unsaturated acids and lower fatty acid; and monomers including carboxylic group such as alkenyl malonic acid, alkenyl glutaric acid, and alkenyl adipic acid.

Furthermore, there are included: esters of acrylic acids or methacrylic acids such as 2-hydroxyethyl acrylate, 2-hydroxyethyl methacrylate, and 2-hydroxypropyl methacrylate; and monomers having hydroxy groups such as 4-(1-hydroxy-1-methylbutyl)styrene and 4-(1-hydroxy-1-methylhexyl)styrene.

In the toner of the present invention, the vinyl-based polymer unit in the binder resin may also include a crosslinked structure crosslinked by a crosslinking agent including two or more vinyl groups.

Examples of the crosslinking agent include: an aromatic divinyl compound such as divinyl benzene and divinyl naphthalene; diacrylate compounds bonded by alkyl chains such as ethylene glycol diacrylate, 1,3-butylene glycol diacrylate, 1,4-butane diol diacrylate, 1,5-pentane diol diacrylate, 1,6-hexane diol diacrylate, neopentyl glycol diacrylate; dimethacrylate compounds bonded by alkyl chains such as ethylene glycol dimethacrylate, 1,3-butylene glycol dimethacrylate, 1,4-butane diol dimethacrylate, 1,5-pentane diol dimethacrylate, 1,6-hexane diol dimethacrylate, neopentyl glycol dimethacrylate;

diacrylate compounds bonded by alkyl chains including ether bond such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate; dimethacrylate compounds bonded by alkyl chains including ether bond such as diethylene glycol dimethacrylate, triethylene glycol dimethacrylate, tetraethylene glycol dimethacrylate, polyethylene glycol #400 dimethacrylate, polyethylene glycol #600 dimethacrylate, dipropylene glycol dimethacrylate; diacrylate compounds bonded by chains including aromatic group and ether bond such as polyoxyethylene (2)-2,2-bis(4-hydroxyphenyl)propane diacrylate, polyoxyethylene(4)-2,2-bis(4-hydroxyphenyl)propane diacrylate; dimethacrylate compounds bonded by chains including aromatic group and ether bond such as polyoxyethylene(2)-2,2-bis(4-hydroxyphenyl)propane dimethacrylate, polyoxyethylene(4)-2,2-bis(4-hydroxyphenyl)propane dimethacrylate.

Examples of a multifunctional crosslinking agent include: pentaerythritol triacrylate, trimethylol ethane triacrylate, trimethylol propane triacrylate, tetramethylol methane tetraacrylate, oligo ester acrylate; pentaerythritol trimethacrylate, trimethylol ethane trimethacrylate, trimethylol propane trimethacrylate, tetramethylol methane tetramethacrylate, oligo ester methacrylate; triallyl cyanurate and triallyl trimellitate.

In the present invention, it is preferable that one or both of a vinyl-based polymer component and a polyester resin component comprise a monomer component that can react with both the resin components.

Examples of a monomer that can react with a vinyl-based polymer out of monomers constituting a polyester resin component include: unsaturated dicarboxylic acids such as phthalic acid, maleic acid, citraconic acid, and itaconic acid; and anhydrides of these acids.

Examples of a monomer that can react with a polyester resin component out of monomers constituting a vinyl-based polymer component include: a monomer having a carboxyl group or a hydroxyl group; an acrylate; and a methacrylate.

A preferable method of yielding a reaction product of a vinyl-based polymer and a polyester resin is as follows. A polymerization reaction to yield one or both of the vinyl-based polymer and the polyester resin is subjected in the presence of a polymer containing any of the above-described monomer components that can react with each of the vinyl-based polymer and the polyester resin.

Examples of a polymerization initiator for use in manufacturing the vinyl-based polymer of the present invention include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(1-cyclohexane carbonitrile), 2-(carbamoyl azo)-isobutyronitrile, 2,2'-azobis(2,4,4-trimethyl pentane), 2-phenyl azo-2,4-dimethyl-4-methoxyvaleronitrile, 2,2'-azobis(2-methylpropane); ketone peroxides such as methyl ethyl ketone peroxide, acetyl acetone peroxide, and cyclohexanone peroxide; 2,2-bis(t-butyl peroxy) butane, t-butyl hydroperoxide, cumene hydroperoxide, 1,1,3,3-tetramethyl butyl hydroperoxide, di-t-butyl peroxide, t-butyl cumyl peroxide, di-cumyl peroxide, (α,α'-bis(t-butyl peroxyisopropyl)benzene, isobutyl peroxide, octanoyl peroxide, decanoyl peroxide, lauroyl peroxide, 3,5,5-trimethyl hexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethyoxy ethyl peroxycarbonate, di-methoxyisopropyl peroxydicarbonate, di(3-methyl-3-methoxybutyl) peroxycarbonate, acetylcyclohexyl sulfonyl peroxide, t-butyl peroxyacetate, t-butyl peroxyisobutylate, t-butyl peroxyneodecanoate, t-butyl peroxy-2-ethyl hexanoate, t-butyl peroxylaurate, t-butyl peroxybenzoate, t-butyl peroxyisopropyl carbonate, di-t-butyl peroxyisophthalate, t-butyl peroxyallyl carbonate, t-amyl peroxy-2-ethyl hexanoate, di-t-butyl peroxyhexahydroterephthalate, and di-t-butyl peroxyazelate.

Examples of a method of preparing a hybrid resin to be used in the toner of the present invention include the following methods described in the items (1) to (6).

(1) A method in which a vinyl-based polymer, a polyester resin, and a hybrid resin component are blended after their production. The blending is performed by dissolving and swelling the polyester resin and the hybrid resin component in an organic solvent (for example, xylene) and then distilling out the organic solvent. An ester compound can be used as the hybrid resin component, which is synthesized by separately producing a vinyl-based polymer and a polyester resin, dissolving and swelling the vinyl-based polymer and the polyester resin in a small amount of organic solvent, adding an esterification catalyst and alcohol to the solution, and heating the mixture to carry out an ester exchange reaction.

(2) A method in which a polyester unit and a hybrid resin component are produced in the presence of a vinyl-based polymer unit after the production of the vinyl-based polymer unit. The hybrid resin component is produced by a reaction between the vinyl-based polymer unit (a vinyl-based monomer may be added as required) and one or both of a polyester monomer (for example, alcohol or a carboxylic acid) and polyester. An organic solvent can be used as appropriate in this case as well.

(3) A method in which a vinyl-based polymer unit and a hybrid resin component are produced in the presence of a polyester unit after the production of the polyester unit. The hybrid resin component is produced by a reaction between the polyester unit (a polyester monomer may be added as required) and one or both of a vinyl-based monomer and the vinyl-based polymer unit.

(4) A method of producing a hybrid resin component including: producing a vinyl-based polymer unit and a polyester unit; and adding one or both of a vinyl-based monomer and a polyester monomer (for example, alcohol or a carboxylic acid) in the presence of these polymer units to carry out a polymerization reaction. An organic solvent can be used as appropriate in this case as well.

(5) A method in which, after the production of a hybrid resin component, one or both of a vinyl-based monomer and a polyester monomer (for example, alcohol or a carboxylic acid) is added to carry out one or both of addition polymerization and a condensation polymerization reaction to thereby produce a vinyl-based polymer unit and a polyester unit. In this case, a hybrid resin component produced by any one of the methods for producing described in the above items (2) to (4) can also be used, and also one produced by a known method for producing can be used as required. In addition, an organic solvent can be used as appropriate.

(6) A method in which a vinyl-based monomer and a polyester monomer (for example, alcohol or a carboxylic acid) are mixed to successively carry out addition polymerization and a condensation polymerization reaction to thereby produce a vinyl-based polymer unit, a polyester unit, and a hybrid resin component. In addition, an organic solvent can be used as appropriate.

In each of the methods for producing described in the above items (1) to (6), multiple polymer units different from each other in molecular weight and in degree of crosslinking can be used for each of the vinyl-based polymer unit and the polyester unit.

A mixture of the polyester resin and the hybrid resin described above may be used as the binder resin to be comprised in the toner of the present invention.

A mixture of the polyester resin and the vinyl-based polymer described above may be used as the binder resin to be comprised in the toner of the present invention.

A mixture of the hybrid resin and the vinyl-based polymer described above may be used as the binder resin to be comprised in the toner of the present invention.

The binder resin to be comprised in the toner of the present invention has a glass transition temperature of preferably 40 to 90° C., more preferably 45 to 85° C. The binder resin has an acid value of preferably 1 to 40 mgKOH/g.

The toner of the present invention can be used in combination with a known charge control agent. Examples of such a charge control agent include organometallic complexes, metal salts, and chelate compounds such as monoazo metal complexes, acetylacetone metal complexes, hydroxycarboxylic acid metal complexes, polycarboxylic acid metal complexes, and polyol metal complexes. In addition to the above compounds, the examples thereof include: carboxylic acid derivatives such as carboxylic acid metal salts, carboxylic anhydrides, and carboxylates; and condensates of aromatic compounds. Examples of a charge control agent include phenol derivatives such as bisphenols and calixarenes. In the present invention, metal compounds of aromatic carboxylic acid is preferably used to render rising of charge satisfactory.

In the present invention, a charge control agent content is preferably 0.1 to 10 parts by mass, more preferably 0.2 to 5 parts by mass with respect to 100 parts by mass of the binder resin. A charge control agent content of less than 0.1 parts by mass may increase variations in charge amount of the toner under environments including a high-temperature and high-humidity environment and a low-temperature and low-humidity environment. A charge control agent content of more than 10 parts by mass may reduce low temperature fixability of the toner.

Examples of the releasing agent to be used in the present invention include: aliphatic hydrocarbon-based waxes such as a low molecular weight polyethylene wax, a low molecular weight polypropylene wax, a microcrystalline wax, a paraffin wax, and a Fischer-Tropsch wax; oxides of aliphatic hydrocarbon-based waxes such as a polyethylene oxide wax; waxes mainly composed of fatty esters such as an aliphatic hydrocarbon-based ester wax; and fatty ester waxes such as a deoxidized carnauba wax obtained by removing part or whole of acidic components. The examples thereof further include: partially esterified products of fatty acids and polyhydric alcohols such as behenic monoglyceride; and methyl ester compounds having hydroxyl groups obtained through hydrogenation of vegetable oils and fats.

Aliphatic hydrocarbon-based waxes such as a paraffin wax, a polyethylene wax, and a Fischer-Tropsch wax are particularly preferably used because of their short molecular chains, little steric hindrance, and excellent mobility.

A molecular weight distribution of the releasing agent has a main peak preferably in the molecular weight range of 350 to 2,400, more preferably in the molecular weight range of 400 to 2,000. The use of a releasing agent having such a molecular weight distribution is effective in imparting preferable heat characteristics to the toner.

The toner of the present invention has one or two or more endothermic peaks in the temperature range of 30 to 200° C. at an endothermic curve in differential scanning calorimetry (DSC). A temperature Tsc at which the largest endothermic peak is present (hereinafter, referred to as "largest endothermic peak temperature") preferably satisfies the relationship of 65° C.≦Tsc≦110° C., more preferably satisfies the relationship of 70° C.≦Tsc≦90° C.

If the largest endothermic peak temperature is less than 65° C., the toner tends to undergo blocking because of its large specific surface area. If the largest endothermic peak temperature exceeds 110° C., low temperature fixability decreases, so that it may be impossible to apply the toner to a high-speed machine.

The largest endothermic peak refers to an endothermic peak with the largest distance measured from a base line of the endothermic peaks in the range above a range exist endothermic peaks originated in the glass transition temperature of the binder resin. The largest endothermic peak temperature can be adjusted according to the kind of the releasing agent to be used.

The releasing agent to be used in the present invention has one or two or more endothermic peaks in the temperature range of 30 to 200° C. at an endothermic curve in differential scanning calorimetry (DSC). In order to obtain the above preferable heat characteristics of the toner, a largest endothermic peak temperature is preferably in the range of 60 to 110° C. (more preferably in the range of 70 to 90° C.).

The content of the releasing agent to be used in the present invention is preferably 1 to 10 parts by mass, more preferably 2 to 8 parts by mass with respect to 100 parts by mass of the binder resin. If the content of the releasing agent is less than 1 part by mass, releasability may not be exert exhibited well upon oilless fixing, or low temperature fixability may deteriorate. If the content of the releasing agent exceeds 10 parts by mass, it may become difficult to control the releasing-agent existence state near the toner particle surface. In addition, the releasing agent behaves as a mass, so that the toner may become obscure.

Known pigments and dyes may be used alone or in combination as the colorant to be used in the present invention. Examples of the dyes include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

Examples of the pigments include Mineral Fast Yellow, Navel Yellow, Naphthol Yellow S, Hansa Yellow G, Permanent Yellow NCG, Tartrazine Lake, Molybdenum Orange, Permanent Orange GTR, Pyrazolone Orange, Benzidine Orange G, Permanent Red 4R, Watching Red calcium salt, eosine lake, Brilliant Carmine 3B, Manganese Violet, Fast Violet B, Methyl Violet Lake, Cobalt Blue, Alkali Blue Lake, Victoria Blue Lake, Phthalocyanine Blue, Fast Sky Blue, Indanthrene Blue BC, Chrome Green, Pigment Green B, Malachite Green Lake, and Final Yellow Green G.

In addition, in the case where each pigment is used as a toner for forming a full-color image, examples of a magenta coloring pigment include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, and 238; C.I. Pigment Violet 19; and C.I. Vat Red 1, 2, 10, 13, 15, 23, 29, and 35.

Although each of the pigments may be used alone, it is preferable to use a dye and a pigment in combination to increase the sharpness of a full-color image from the viewpoint of its image quality.

Examples of a magenta dye include: oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

Examples of a cyan coloring pigment include: C.I. Pigment Blue 2, 3, 15, 15:3, 16, and 17; C.I. Acid Blue 6; C.I. Acid Blue 45; and copper phthalocyanine pigments each having a phthalocyanine skeleton to which 1 to 5 phthalimidomethyl groups are added.

Examples of a yellow coloring pigment include: C.I. Pigment Yellow 1, 2, 3, 4, 5, 6, 7, 10, 11, 12, 13, 14, 15, 16, 17, 23, 65, 73, 74, 83, 93, 97, 155, and 180; and C.I. Vat Yellow 1, 3, and 20.

The usage amount of the colorant is preferably 1 to 15 parts by mass, more preferably 3 to 12 parts by mass, still more preferably 4 to 10 parts by mass with respect to 100 parts by mass of the binder resin. If the content of the colorant is greater than 15 parts by mass, transparency decreases and reproducibility of an intermediate color typified by a human flesh color is liable to decrease. Moreover, stability of chargeability of the toner decreases, and it becomes difficult to obtain low temperature fixability. If the content of the colorant is less than 1 part by mass, coloring power decreases, and thus the toner must be used in a large amount in order to achieve the requisite density. In this case, dot reproducibility is easily impaired, it makes difficult to obtain a high-quality image with a high image density.

In the present invention, it is preferable that inorganic fine particles be externally added to the toner particles before use for the purpose of improving transferability. The inorganic fine particles to be externally added to the toner surface are one or more kinds selected from the group consisting of a titanium oxide fine particle, an alumina fine particle, and a silica fine particle. A main peak particle diameter of the inorganic fine particles in a particle size distribution based on the number is preferably in the range of 80 to 200 nm. Furthermore, the main peak particle diameter of the inorganic fine particles is more preferably in the range of 90 to 150 nm for allowing the inorganic fine particles to function as appropriate spacers on the toner particle surface and for obtaining satisfactory transferability with no toner scattering.

If the main peak particle diameter of the inorganic fine particles is less than 80 nm, a toner having a small particle diameter hardly separates from a magnetic carrier upon development, and hardly separates from a photosensitive member upon transfer owing to a strong image force, so that transferability decreases in some cases. If the main peak particle diameter of the inorganic fine particles exceeds 200 nm, adhesion of the particles to the toner weakens. As a result, the particles scatter to cause contamination in a machine and a reduction in charge amount of the toner due to accumulation of the particles. It is more preferable that the surface of each of the inorganic fine particles to be used in the present invention be subjected to a hydrophobizing treatment. In addition, the inorganic fine particles may be subjected to an oil treatment.

The content of the inorganic fine particles to be used in the present invention is preferably 0.8 to 8.0 parts by mass, more preferably 1.0 to 4.0 parts by mass with respect to 100 parts by mass of the toner particles.

Furthermore, in the present invention, other particles may be externally added to the toner particles before use together with the inorganic fine particles for the purpose of improving flowability. Examples of the fine particles to be used include: fluororesin powder such as vinylidene fluoride fine powder and tetrafluoroethylene fine powder; titanium oxide fine powder, alumina fine powder; finely powdered silica such as wet manufacturing silica, and dry manufacturing silica; and treated silica fine powder obtained by treating the surface of any of the above with a silane compound, an organosilicon compound, a titanium coupling agent, or silicone oil.

A primary particle diameter of any of the above fine powder to be used is preferably in the range of 10 to 70 nm. In particular, the use of fine powder having a primary particle diameter of 10 to 50 nm is preferable because this can impart further flowability to the toner and can render developability satisfactory over prolonged use.

The addition amount of the fine particles for improving flowability is preferably 0.3 to 4.0 parts by mass, more preferably 0.5 to 3.0 parts by mass with respect to 100 parts by mass of the toner particles.

The toner of the present invention can be preferably produced according to a method for producing including: a step of sufficiently mixing a binder resin, a colorant, a releasing agent, and another optional component such as an organometallic compound in a mixer such as Henschell Mixer or a ball mill; a step of melting, kneading, and milling the mixture by using a heat kneading machine such as a kneader or an extruder; a step of finely pulverizing the melted kneaded product after cooling the melted kneaded product to obtain finely pulverized products; and a step of surface modifying in which the resultant finely pulverized products are subjected to surface modifying to obtain surface-modified particles.

In the production of the toner of the present invention, each of the step of mixing, kneading, and pulverizing described above is not particularly limited, and can be performed under normal conditions with a known apparatus.

In the production of the toner of the present invention, the step of surface modifying is not particularly limited as long as it is a step that enables the releasing-agent existence state on the toner particle surface to be appropriately controlled. However, the step of surface modifying is particularly preferably performed by using the batch-type surface modifying apparatus shown in FIG. 1 in producing the toner of the present invention. The surface modifying apparatus to be used in the step of surface modifying and the method for producing a toner using the surface modifying apparatus will be described specifically with reference to the drawings.

FIG. 1 shows an example of a surface modifying device used in the present invention.

The surface modifying device shown in FIG. 1 comprises: a casing 15; a jacket (not shown) through which cooling water and an antifreezing fluid can pass; a classifying rotor 1 as classifying means for classifying fine particles having sizes smaller than the predetermined particle size; a dispersing rotor 6 as surface treatment means for treating the surface of the above-mentioned particles by applying a mechanical impact to the particles; liners 4 arranged circumferentially on an inner periphery surface of the casing 15 at a predetermined interval against an outer periphety of the dispersing rotor 6; a guide ring 9 as guiding means for guiding, from among the particles classified by the classifying rotor 1, the particles having the predetermined size to the dispersing rotor 6; a discharge port for collecting fine powders 2 as discharging means for discharging, from among the particles classified by the classifying rotor 1, the fine particles having sizes smaller than the predetermined particle size to the outside of the device; a cold air introduction port 5 as particle circulation means for sending the particles having their surfaces treated by the dispersing rotor 6 to the classifying rotor 1; a raw material supply port 3 for introducing the treated particles into the casing 15; and a powder discharge port 7 and a discharge valve 8, which are openable and closable, for discharging the surface-treated particles from the casing 15.

The classifying rotor 1 is a cylindrical rotor and is provided on one end portion of a surface side inside the casing 15. The fine powder collection discharge port 2 is provided on one end portion of the casing 15 so that particles present inside the classification rotor 1 are discharged therefrom. The raw material supply port 3 is provided in a central portion of a circumferential surface of the casing 15. The cold air introduction port 5 is provided on the other end surface side on the circumferential surface of the casing 15. The powder discharge port 7 is provided on the circumferential surface of the casing 15 at a position opposite to the raw material supply port 3. The discharge valve 8 is a valve capable of freely opening and closing the powder discharge port 7.

Figure 2:
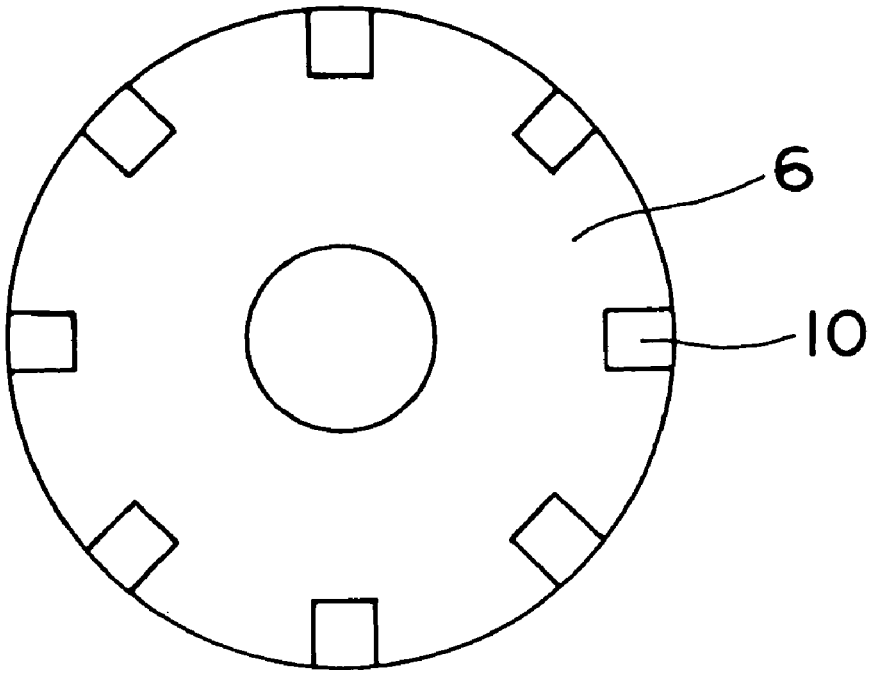
FIG. 2 is a schematic view showing an example of a top view of a dispersing rotor shown in FIG. 1.

The dispersing rotor 6 and the liners 4 are provided between the cold air introduction port 5 and the raw material supply port 3 and between the cold air introduction port 5 and the powder discharge port 7, respectively. The liners 4 are arranged circumferentially along an inner peripheral surface of the casing 15. As shown in FIG. 2, the dispersing rotor 6 comprises a circular disk and plural square disks 10 arranged on normal of the circular disk along the outer edge of the circular disk. The dispersing rotor 6 is provided on the other end surface side of the casing 15 and arranged such that a predetermined gap is formed between each liner 4 and each square disk 10.

The guide ring 9 is provided in the central portion of the casing 15. The guide ring 9 is a cylindrical member provided so as to extend from a position where it covers a part of the outer peripheral surface of the classifying rotor 1 to the vicinity of the classifying rotor 1. The guide ring 9 forms a first space 11 and a second space 12 in the casing 15. The first space 11 is a space sandwiched between the outer peripheral surface of the guide ring 9 and the inner peripheral surface of the casing 15. The second space 12 is a space inside the guide ring 9.

The dispersing rotor 6 may include cylindrical pins instead of the square disks 10. While in this embodiment each liner 4 has a large number of grooves provided on its surface opposing the square disk 10, the liner 4 may not have such grooves on its surface. Also, the classifying rotor 1 may be installed either vertically as shown in FIG. 1 or horizontally. In addition, one classifying rotor 1 maybe provided as shown in FIG. 1, or two or more classifying rotors 1 may be provided.

Hereinafter, a description is given of the step of surface modifying using the surface modifying apparatus shown in FIG. 1 when producing the toner of the present invention.

In the surface modifying device constructed as described above, when a finely pulverized article is introduced from the raw material supply port 3 with the discharged valve 8 being in the "closed" state, the introduced finely pulverized article is sucked in by a blower (not shown) and then subjected to classification by the classifying rotor 1. At this time, fine powders classified as having particle sizes equal to a predetermined particle size or smaller pass through the circumferential surface of the classifying rotor 1 to be introduced into the inside of the classifying rotor 1, and then continuously discharged and removed from the device to the exterior. Coarse powders having particle sizes equal to or larger than the predetermined particle size are carried on a circulation flow generated by the dispersing rotor 6 while moving along an inner periphery (second space 12) of the guide ring 9 due to a centrifugal force, to be introduced to the gap (hereinafter also referred to as the "surface modifying zone") between the square disk 10 and the liner 4.

The powders introduced into the surface modifying zone are subjected to surface modifying by receiving a mechanical impact force between the dispersing rotor 6 and the liner 4. The surface-modified powder particles are carried on cold air passing through inside the machine, to be transported along the outer periphery (first space 11) of the guide ring 9 to reach the classifying rotor 1. By the classifying rotor 1, the fine powers are discharged to the outside of the machine whereas the coarse powders are returned again to the second space 12 where the surface modifying operation is repeated therefore.

In this way, with the surface modifying device of FIG. 1, the classification of particles using the classifying rotor 1 and the surface treatment of the particles using the dispersing rotor 6 are repeated. After a given period of time has elapsed, the discharge valve 8 is opened to collect the surface-modified particles from the discharge port 7.

The inventors of the present invention have made studies to found out that a surface modifying time period (=cycle time) in the surface modifying apparatus is preferably 5 to 180 seconds, more preferably 15 to 120 seconds. A surface modifying time period of less than 5 seconds is not preferable from the viewpoint of toner quality because a surface-modified particle may not be obtained owing to the excessively short surface modifying time period. In addition, a surface modifying time period in excess of 180 seconds is not preferable from the viewpoint of toner productivity because surface deterioration of the toner, that is, exudation of the releasing agent, fusion of the toner in the machine, and a reduction in throughput due to heat generated during the surface modifying take place owing to the excessively long surface modifying time period.

In addition, a weight average particle diameter of the toner particles prior to the surface modifying is preferably in the range of 2.5 to 6.0 μm in realizing the final weight average particle diameter of the toner described above.

Furthermore, in the method for producing the toner of the present invention, a temperature T1 of cold air to be introduced into the surface modifying apparatus is preferably set to 5° C. or less. Setting the temperature T1 of the cold air to be introduced into the surface modifying apparatus to 5° C. or less (more preferably 0° C. or less, still more preferably −5° C. or less) can further prevent the surface deterioration of the toner and the fusion of the toner in the machine due to heat generated during the surface modifying. Setting the temperature T1 of the cold air to be introduced into the surface modifying apparatus to more than 5° C. is not preferable from the viewpoint of toner productivity because this easily causes the surface deterioration of the toner due to heat generated during the surface modifying and the fusion of the toner in the machine.

Furthermore, in the method for producing the toner of the present invention, the surface modifying apparatus preferably includes a jacket for cooling the inside of the apparatus to subject a finely pulverized product to surface modifying while passing a coolant (preferably cooling water, more preferably antifreeze such as ethylene glycol) through the jacket. Cooling the inside of the apparatus by means of the jacket can further prevent the surface deterioration of the toner due to heat generated during the surface modifying of the toner and the fusion of the toner in the machine.

The temperature of the coolant to be passed through the jacket of the surface modifying apparatus is preferably set to 5° C. or less. Setting the temperature of the coolant to be passed through the jacket in the surface modifying apparatus to 5° C. or less (more preferably 0° C. or less, still more preferably −5° C. or less) can further prevent the surface deterioration of the toner and the fusion of the toner in the machine due to heat generated during the surface modifying. Setting the temperature of the coolant to be introduced into the jacket to more than 5° C. is not preferable from the viewpoint of toner productivity because this easily causes the surface deterioration of the toner due to heat generated during the surface modifying and the fusion of the toner in the machine.

Furthermore, in the method for producing the toner of the present invention, a temperature T2 of the next position of a classifying rotor in the surface modifying apparatus is preferably set to 60° C. or less. Setting the temperature T2 of the next position of the classifying rotor in the surface modifying apparatus to 60° C. or less (preferably 40° C. or less, more preferably 30° C. or less) can further prevent the surface deterioration of the toner due to heat generated during the surface modifying and the fusion of the toner in the machine.

A temperature T2 of the next position of the classifying rotor in the surface modifying apparatus in excess of 60° C. is not preferable from the viewpoint of toner productivity because a temperature above 60° C. affects the surface modifying zone and thus the surface deterioration of the toner due to heat generated during the surface modifying and the fusion of the toner in the machine can easily take place.

Furthermore, in the method for producing the toner of the present invention, a temperature difference ΔT(T2-T1) between the temperature T2 of the next position of the classifying rotor in the surface modifying apparatus and the temperature T1 of the cold air to be introduced into the surface modifying apparatus is preferably set to 80° C. or less. If the temperature difference ΔT(T2-T1) between the temperature T2 of the next position of the classifying rotor in the surface modifying apparatus and the temperature T1 of the cold air to be introduced into the surface modifying apparatus is set to 80° C. or less (more preferably 70° C. or less), the surface deterioration of the toner due to heat generated during the surface modifying and the fusion of the toner in the machine can be further prevented.

If the temperature difference ΔT(T2-T1) between the temperature T2 of the next position of the classifying rotor in the surface modifying apparatus and the temperature T1 of the cold air to be introduced into the surface modifying apparatus exceeds 80° C., a temperature above 80° C. affects the surface modifying zone and thus the surface deterioration of the toner due to heat generated during the surface modifying and the fusion of the toner in the apparatus can easily take place. Therefore, a temperature difference ΔT(T2-T1) in excess of 80° C. is not preferable from the viewpoint of toner productivity.

Furthermore, in the method for producing the toner of the present invention, a minimum space between the dispersing rotor and the liner in the surface modifying apparatus is preferably set to be within the range of 0.5 to 15.0 mm, more preferably within the range of 2.0 to 10.0 mm. In addition, a rotating peripheral speed of the dispersing rotor is preferably set to be within the range of 75 to 150 m/sec, more preferably within the range of 85 to 140 m/sec. Furthermore, a minimum space between an upper part of the square disks or cylindrical pins arranged on the top face of the dispersing rotor in the surface modifying apparatus and a lower part of the cylindrical guide ring is preferably set to be within the range of 2.0 to 50.0 mm, more preferably within the range of 5.0 to 45.0 mm.

After the above-described surface treatment, the toner of the present invention can be obtained by mixing one or both of inorganic fine particles and fine particles each containing a flowability improving agent are sufficiently mixed and the toner particles in a mixer such as Henschell Mixer. As a result, a toner having one or both of the inorganic fine particles and the flowability improving agent on its toner particle surface can be obtained. At that time, it is preferable that an inorganic fine particle having a small particle diameter be adhered to the toner surface first and a particle having a large particle diameter be then externally added for adjusting a BET specific surface area of the toner to be within a desired range and for ensuring compatibility between satisfactory developability over prolonged use and low temperature fixability.

Figure 4:
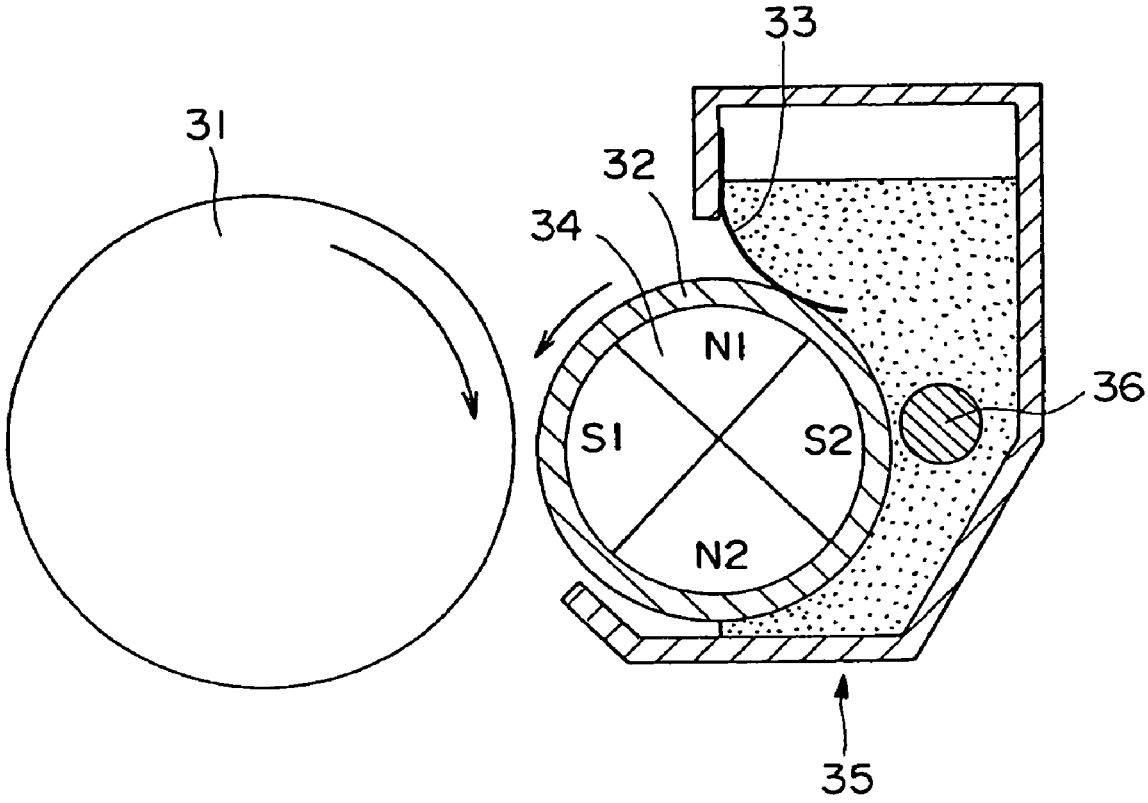
FIG. 4 is a schematic view showing a non-magnetic one-component developing device that can be used in the present invention.

The toner of the present invention may be also used as a non-magnetic one-component developer. An available non-magnetic one-component development method is as follows. By using such an apparatus as shown in FIG. 4, a toner is carried in a thin layer form on a developing sleeve by means of an elastic blade, an elastic roller, or the like to thereby carry out contact development or non-contact development on a photosensitive drum.

In the present invention, the toner of the present invention is preferably mixed with a magnetic carrier to be used as a two-component developer for further improving dot reproducibility and for obtaining a stable image for a long time period.

Examples of an available magnetic carrier include generally known magnetic carriers such as: iron powder with an oxidized surface or unoxidized iron powder; metal particles such as iron, lithium, calcium, magnesium, nickel, copper, zinc, cobalt, manganese, chromium, and rare-earth elements, and alloy particles or oxide particles thereof; magnetic materials such as ferrite; and magnetic material-dispersed resin carriers (so-called resin carriers) each comprising a magnetic material and a binding resin that holds the magnetic material in a dispersed state.

It is preferable to use resin carriers each having a small specific gravity for a toner which has a small particle diameter, which has a releasing agent near the toner surface, and which is excellent in low temperature fixability. Therefore, in the present invention, it is preferable to use a resin-coated carrier comprising: a magnetic core particle comprising a magnetic material; and a coating layer formed from a resin on the surface of the magnetic core particle.

A number average particle diameter of the magnetic carrier to be used in the present invention is preferably in the range of 15 to 80 μm, more preferably in the range of 25 to 50 μm. If the number average particle diameter of the magnetic carrier is less than 15 μm, a mixing property with the toner is improved, but carrier adhesion may occur in which carriers adhere onto a photosensitive member when a fogging removal bias is applied. If the number average particle diameter of the magnetic carrier is more than 80 μm, a stress to the toner increases, and thus exudation of the releasing agent from the toner over prolonged use can not be prevented even if the releasing-agent existence state on the toner surface is controlled. As a result, developability may deteriorate.

A description is given of a magnetic carrier that can be more preferably used in the present invention.

Examples of the binding resin include a vinyl resin which has a methylene unit in its polymer chain, a polyester resin, an epoxy resin, a phenol resin, a urea resin, a polyurethane resin, a polyimide resin, a cellulose resin, and a polyether resin. Those resins may be mixed before use.

Examples of a vinyl-based monomer for producing the vinyl polymer include: styrene; styrene derivatives such as o-methyl styrene, m-methyl styrene, p-methyl styrene, p-phenyl styrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, p-chlorostyrene, 3,4-dichlorostyrene, m-nitrostyrene, o-nitrostyrene, and p-nitrostyrene; ethylene and unsaturated mono-olefins such as ethylene, propylene, butylene, and isobutylene; unsaturated diolefins such as butadiene and isoprene; vinyl halides such as vinyl chloride, vinylidene chloride, vinyl bromide, and vinyl fluoride; vinyl esters such as vinyl acetate, vinyl propionate, and vinyl benzoate; methacrylic acid; α-methylene aliphatic mono-carboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate; acrylic acid; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; maleic acid, half esters of maleic acid; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinyl pyrrole, N-vinyl carbazole, N-vinyl indole, and N-vinyl pyrrolidone; vinyl naphthalene; acrylic derivatives or methacrylic derivatives such as acrylonitrile, methacrylonitrile, and acrylamide; and acrolein.

A product produced by polymerizing one or two or more kinds of those monomers is used as the vinyl resin.

In the present invention, the magnetic core particle is preferably a magnetic material-dispersion type core particle in which a magnetic material in a dispersed state is held by a binding resin. An example of a method for producing magnetic material-dispersion type core particles is a method including: mixing monomers of a binding resin with magnetic materials; and polymerizing the monomers to produce magnetic material-dispersion type core particles.

At this time, examples of the monomers to be used for polymerization include, in addition to the above-described vinyl-based monomers: bisphenols and epichlorohydrin for forming epoxy resins; phenols and aldehydes for forming phenol resins; urea and aldehydes for forming urea resins; and melamine and aldehydes for forming melamine resins. An example of a method for producing magnetic material-dispersion type core particles using a curing type phenol resin is a method including: adding magnetic materials to an aqueous medium; and polymerizing phenols and aldehydes in the aqueous medium in the presence of a basic catalyst to produce magnetic material-dispersion type core particles.

Another example of a method of producing magnetic material-dispersion type resin core particles is a method including: sufficiently mixing a vinyl-based or non-vinyl-based thermoplastic resin, a magnetic material, and another additive in a mixer; melting and kneading the mixture by using a kneading machine such as a heating roll, a kneader, or an extruder; cooling the kneaded product; and pulverizing and classifying the kneaded product to produce magnetic material-dispersion type core particles. At this time, it is preferable to thermally or mechanically sphere the resultant magnetic material-dispersion type core particles to be used as magnetic material-dispersion type core particles for the resin carriers.

Out of the above-described binding resins, thermosetting resins such as a phenol resin, a melamine resin, and an epoxy resin are preferable because of their excellent durability, impact resistance, and heat resistance. A phenol resin is more preferable as a binding resin in order to more suitably express the properties of the present invention.

Magnetic materials are comprised resin carriers before use. The amount of the magnetic materials to be used in the resin carriers is preferably 70 to 95 mass % (more preferably 80 to 92 mass %) with respect to the magnetic carrier for lowering true specific gravity of the magnetic carrier and for ensuring a sufficient mechanical strength. In addition, in order to alter the magnetic properties of the magnetic carrier, it is preferable to compound non-magnetic inorganic compounds instead of a part of the magnetic materials into the magnetic material-dispersion type core particles.

In addition, for increasing specific resistance values for the magnetic carrier, it is preferable that specific resistance values for the non-magnetic inorganic compounds are greater than those for the magnetic materials and a number average particle diameter of the non-magnetic inorganic compounds is greater than that of the magnetic materials.

Figure 3:
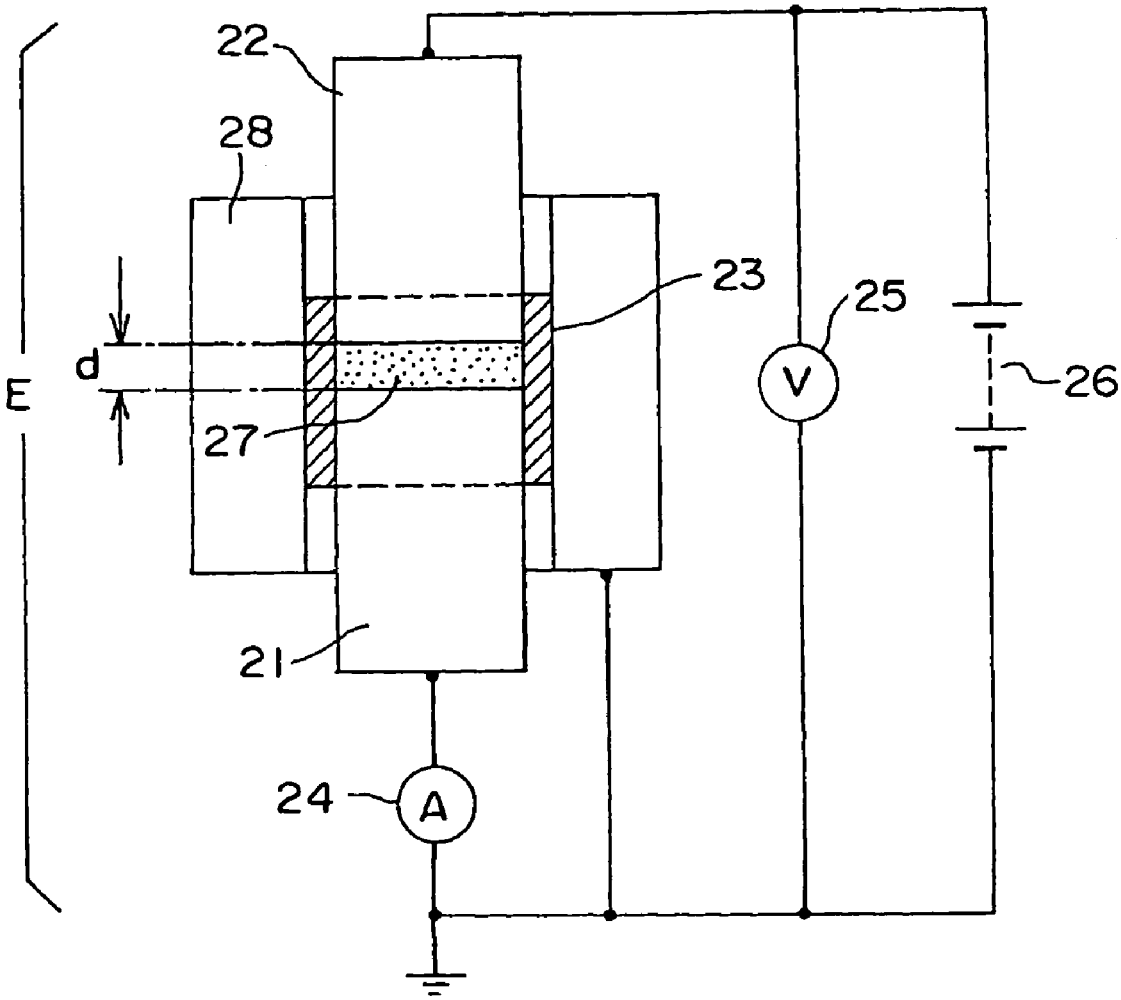
FIG. 3 is a schematic sectional view showing an apparatus for measuring specific resistances of a magnetic carrier, a magnetic material, and a non-magnetic inorganic compound of the present invention.

The specific resistance values for the non-magnetic inorganic compounds and for the magnetic materials can be measured by using the measuring device shown in FIG. 3. A method to be used for measuring a specific resistance is as follows. Carrier particles are loaded into the cell E, and a lower electrode 21 and an upper electrode 22 are arranged to contact the loaded carrier particles. Then, a voltage is applied between the electrodes, and a current passing at that time is measured. Preferable conditions for measuring a specific resistance in the present invention are as follows. A contact area S between the loaded carrier particles and the electrodes is approximately 2.3 $cm^2$, a thickness d is approximately 0.5 mm, and a load of the upper electrode 22 is 180 g.

The content of the magnetic materials is preferably 30 to 100 mass % with respect to the total amount of the magnetic materials and the non-magnetic inorganic compounds for adjusting intensities of magnetization of the resin carries to prevent carrier adhesion and for adjusting the specific resistance values for the magnetic carrier.

Preferably, the magnetic materials in the magnetic carrier to be used in the present invention are magnetite fine particles or magnetic ferrite fine particles each comprising at least an iron element. More preferably, the non-magnetic inorganic compounds are hematite ($\alpha$-$Fe_2O_3$) fine particles for achieving uniform dispersibility in the carriers, and for adjusting the magnetic properties and true specific gravity of the carrier.

The magnetic carrier to be used in the present invention has an intensity of magnetization of preferably 50 to 220 $kAm^2/m^3$ (emu/g×g/$cm^3$) in 79.6 kA/m (1 kOe). An intensity of magnetization of less than 50 $kAm^2/m^3$ easily causes the adhesion of a carrier onto a photosensitive member. An intensity of magnetization of more than 220 $kAm^2/m^3$ increases a stress to the toner to easily cause the migration of the releasing agent to the magnetic carrier, thereby resulting in reduced developability of the toner over prolonged use. The intensity of magnetization can be adjusted by the type and compounding amount of a magnetic material, by the combined use with a non-magnetic inorganic compound, or the like.

It is preferable that a number average particle diameter of the magnetic carrier to be used in the present invention be in the range of 15 to 80 μm and a number average particle diameter of the magnetic materials be in the range of 0.02 to 2 μm from the standpoint of achieving a uniform state of the magnetic carrier particle surface. A number average particle diameter of the non-magnetic inorganic compounds is preferably in the range of 0.05 to 5 μm, and a particle diameter of the non-magnetic inorganic compounds is preferably 1.1 or more times as large as that of the magnetic materials for further increasing surface resistance values for the magnetic core particles.

Examples of phenols for forming phenol resins as binding resins in resin carriers which can be used in the present invention include: phenol itself; alkylphenols such as m-cresol, p-tert-butylphenol, o-propylphenol, resorcinol, and bisphenol A; and compounds each having a phenolic hydroxyl group such as halogenated phenols in each of which part or whole of a benzene nucleus or of an alkyl group is substituted by a chlorine atom or a bromine atom. Of those, phenol (hydroxybenzene) is more preferable.

Examples of aldehydes include formaldehyde in the form of one of formalin and paraldehyde, and furfural. Of those, formaldehyde is particularly preferable.

A molar ratio of aldehydes to phenols is preferably in the range of 1 to 4, particularly preferably in the range of 1.2 to 3. If the molar ratio of aldehydes to phenols is less than 1, a particle is hardly produced. Even if a particle is produced, resin curing hardly proceeds and thus the strength of a particle to be produced tends to weaken. On the other hand, if the molar ratio of aldehydes to phenols is more than 4, the amount of unreacted aldehydes remaining in an aqueous medium after the reaction tends to increase.

Examples of basic catalysts used in subjecting phenols and aldehydes to condensation polymerization include basic catalysts used for ordinary production of resol type resins. Examples of such basic catalysts include ammonia water, alkylamines such as hexamethylenetetramine, dimethylamine, diethyltriamine, and polyethyleneimine. A molar ratio of those basic catalysts to phenols is preferably in the range of 0.02 to 0.30.

An insulating resin is preferably used as a resin for forming a coating layer. The insulating resin that can be used in this case may be a thermoplastic resin or a thermosetting resin.

Specific examples of the thermoplastic resin as the resin for forming a coating layer include: polystyrene; acrylic resins such as polymethyl methacrylate and a styrene-acrylic acid copolymer; a styrene-butadiene copolymer; an ethylene-vinyl acetate copolymer; polyvinyl chloride; polyvinyl acetate; a polyvinylidene fluoride resin; a fluorocarbon resin; a perfluorocarbon resin; a solvent-soluble perfluorocarbon resin; polyvinyl alcohol; polyvinyl acetal; polyvinyl pyrrolidone; a petroleum resin; cellulose; cellulose derivatives such as cellulose acetate, cellulose nitrate, methylcellulose, hydroxymethylcellulose, hydroxyethylcellulose, and hydroxypropylcellulose; a novolac resin; low molecular weight polyethylene; saturated alkylpolyester resin, aromatic polyester resins such as a polyethylene terephthalate, polybutylene terephthalate, and polyarylate; a polyamide resin; a polyacetal resin; a polycarbonate resin; a polyethersulfone resin; a polysulfone resin; a polyphenylene sulfide resin; and a polyetherketone resin.

Examples of the thermosetting resin include: a phenol resin; a denatured phenol resin; a maleic resin; an alkyd resin; an epoxy resin; an acrylic resin; unsaturated polyester obtained by polycondensation of maleic anhydride, terephthalic acid, and a polyhydric alcohol; a urea resin; a melamine resin; a urea-melamine resin; a xylene resin; a toluene resin; a guanamine resin; a melamine-guanamine resin; an acetoguanamine resin; a glyptal resin; a furan resin; a silicone resin; polyimide; a polyamideimide resin; a polyetherimide resin; and a polyurethane resin.

Each of the above-described resins may be used alone, or two or more of the above-described resins may be mixed before use. In addition, a curing agent or the like may be mixed with a thermoplastic resin to cure the thermoplastic resin before use. According to a particularly preferable embodiment, a resin having higher releasability is used for a toner having a small particle diameter and comprising a releasing agent.

In particular, in the present invention, the resin for forming a coating layer is preferably a resin comprising a polymer that has a fluorine atom. In a toner having a small particle diameter, comprising a releasing agent, and achieving low temperature fixing such as the toner of the present invention, the aggregation property of the toner due to the releasing agent near the toner surface increases. Then, when the toner is turned into a developer (for instance, a state where the toner is mixed with a magnetic carrier), flowability of the developer deteriorates. As a result, rising of charge of the toner may deteriorate. Furthermore, the developer in a developer container starts to receive a stress, and a reduction in developability may occur over prolonged use.

In view of the above, it is important to use a resin comprising a polymer that has a fluorine atom as the resin for forming a coating layer, particularly for improving flowability of the magnetic carrier.

Specific examples of the resin comprising a polymer that has a fluorine atom to be used in the present invention include: polyvinyl fluoride; polyvinylidene fluoride; polytrifluoroethylene; a perfluoropolymer such as polyfluorochloroethylene; polytetrafluoroethylene; polyperfluoropropylene; a copolymer of vinylidene fluoride and an acrylic monomer; a copolymer of vinylidene fluoride and trifluorochloroethylene; a copolymer of tetrafluoroethylene and hexafluoropropylene; a copolymer of vinyl fluoride and vinylidene fluoride; and a copolymer of vinylidene fluoride and tetrafluoroethylene. A resin for forming a coating layer which is particularly preferably used in the present invention is a resin comprising a (meth)acrylic acid perfluoroalkyl polymer that has at least a perfluorinated alkyl unit.

The perfluorinated alkyl unit is more preferably a polymer of a (meth)acrylate having a perfluorinated alkyl unit that is represented by the following formula (2) or (3), or a copolymer of the (meth)acrylate and another monomer from the viewpoint of releasability from the toner:

$$CF_3-(CF_2)_m- \tag{2}$$

(In the formula, m denotes an integer of 0 to 10.);

$$CF_3-(CF_2)_m-(CH_2)_n- \tag{3}$$

(In the formula, m denotes an integer of 0 to 10, and n denotes an integer of 1 to 15.).

The perfluorinated alkyl unit is more preferably a polymer of a (meth)acrylate having a perfluorinated alkyl unit that is represented by the following formula (4) or a copolymer of the (meth)acrylate and another monomer for preventing an external additive from adhering to the carrier particle surface:

$$CF_3-(CF_2)_m- \tag{4}$$

(In the formula, m denotes an integer of 4 to 8.).

In the case where a thermoplastic resin is used as the resin for forming a coating layer, the thermoplastic resin has a weight average molecular weight of preferably 20,000 to 300,000 in gel permeation chromatography (GPC) of tetrahydrofuran (THF) soluble component from the viewpoints of enhancing the strength of the coating layer, the adherence between the coating layer and the magnetic core particles, and the adhesion of the thermoplastic resin to the magnetic core particles.

It is preferable that the resin for forming a coating layer have a main peak in the molecular weight range of 2,000 to 100,000 in a chromatogram of GPC of THF soluble component. It is more preferable that the resin for forming a coating layer have a sub-peak or a shoulder in the molecular weight range of 2,000 to 100,000. It is most preferable that the resin for forming a coating layer has a main peak in the molecular weight range of 20,000 to 100,000 and has a sub-peak or a shoulder in the molecular weight range of 2,000 to 19,000 in the chromatogram of GPC of THF soluble component. Satisfying the above molecular weight distribution conditions further improves development durability for developing many sheets even when a toner having a small particle diameter is used, stability of charging of the toner, and the property of preventing an external additive from adhering to the carrier particle surface.

In addition, in the case where the resin for forming a coating layer is a graft polymer, a backbone of the graft polymer has a weight average molecular weight of preferably 30,000 to 200,000 and a branch of the graft polymer has a weight average molecular weight of preferably 3,000 to 10,000. The weight average molecular weight can be adjusted according to polymerization conditions for a backbone part of the graft polymer and polymerization conditions for a branch part of the graft polymer.

Furthermore, the coating layer preferably comprises particles each having electric conductivity or particles each having charge controllability. Such a coating layer is preferably prepared by incorporating particles each having electric conductivity or particles each having charge controllability into the resin for forming a coating layer or monomers for forming the resin and by coating magnetic core particles with the resin or the monomers according to an appropriate method. Those particles are important in that the particles softly and quickly impart charge to a toner having a small particle diameter and low temperature fixability.

The particles each having electric conductivity are preferably particles each having a specific resistance of $1\times10^8$ Ωcm or less, more preferably particles each having a specific resistance of $1\times10^6$ Ωcm or less. Specifically, the particles each having electric conductivity preferably comprise at least one kind of particle selected from carbon black, magnetite, graphite, zinc oxide, and tin oxide. Carbon black having satisfactory electric conductivity is particularly preferable as a particle having electric conductivity for achieving a satisfactory property of imparting charge to the toner (rising of charge).

A number average particle diameter of the particles each having electric conductivity is preferably 1 μm or less in order to prevent falling-off of particles from carriers and in order for the particles to function as uniform conducting sites.

Examples of the particles each having charge controllability include particles of organometallic complexes, particles of organic metal salts, particles of chelate compounds, particles of monoazo metal complexes, particles of acetylacetone metal complexes, particles of hydroxycarboxylic acid metal complexes, particles of polycarboxylic acid metal complexes, and particles of polyol metal complexes. Although charge control agents to be dispersed in toner particles may be used, resin particles having functional groups or inorganic particles treated with treating agents having functional groups are preferably used for achieving a satisfactory property of imparting charge to the toner.

Specifically, the particles each having charge controllability preferably comprise at least one kind of particle selected from a polymethyl methacrylate resin particle, a polystyrene resin particle, a melamine resin particle, a phenol resin particle, a nylon resin particle, a silica particle, a titanium oxide particle, and an alumina particle. A titanium oxide particle and an alumina particle which have been subjected to surface treatment with conductive treating agents can also be used as the particles each having electric conductivity. Furthermore, inorganic particles are preferably treated with various coupling agents before use in order to express charge controllability and electric conductivity.

A number average particle diameter of the particles each having charge controllability is preferably in the range of 0.01 to 1.5 μm in order for the particles to function as uniform charging sites.

A coating amount of the resin for forming a coating layer is preferably 0.1 to 5.0 parts by mass with respect to 100 parts by mass of the magnetic core particles for enhancing the property of imparting charge to the toner and durability of the magnetic carrier. In addition, the total compounding amount of the particles each having electric conductivity and/or the particles each having charge controllability is preferably 0.1 to 30 parts by mass with respect to 100 parts by mass of the resin for forming a coating layer.

If the above-described particles are added in an amount above 30 parts by mass, the particles are hardly dispersed in the resin for forming a coating layer, so that the particles may be detached from the magnetic carrier. In particular, in the case where carbon black is added, contamination of the toner by the carbon black occurs over prolonged use, so that the toner may blacken.

According to the present invention, there can be provided a toner which is excellent in transferability, dot reproducibility, and fine line reproducibility, in which a large amount of oil is not applied or no oil is applied, and which is excellent in low temperature fixability and hot offset resistance, and a two-component developer.

In addition, the toner and two-component developer of the present invention enable an image with a high gloss to be printed at a high speed and prevent a reduction in image quality over prolonged use.

Preferable measurement methods for physical properties related to the present invention are described below.

Measurement of Particle Size Distribution of Toner Particles or Toner

Coulter Counter TA-II or Coulter Multisizer II (manufactured by Beckman Coulter, Inc) is used as a measuring device. An about 1% aqueous solution of NaCl is used as an electrolyte. For example, an electrolyte prepared by using first class grade sodium chloride or ISOTON (registered trademark)-II (manufactured by Coulter Scientific Japan) can be used as the electrolyte.

A measurement method is as follows. 0.1 to 5 ml of a surfactant (preferably an alkyl benzene sulfonate) is added as a dispersant to 100 to 150 ml of the electrolyte. Then, 2 to 20 mg of measurement samples are added to the electrolyte. The electrolyte in which the samples are suspended is subjected to dispersion treatment in an ultrasonic dispersing apparatus for about 1 to 3 minutes. After that, by using a 100 μm aperture as an aperture, the volumes and number of samples are measured for each channel by the measuring device to calculate the volume and number distributions of the samples. The weight average particle diameter and number average particle diameter of the samples are determined form the resultant distributions. Used as the channels are 13 channels of: 2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

Measurement of Average Circularity

A circle-equivalent diameter of the toner, circularity of the toner, and a distribution of frequency thereof are used as simple measures of quantitatively expressing shapes of toner particles. In the present invention, measurement is carried out by using a flow-type particle image measuring device 'FPIA-2100' (manufactured by Sysmex Corporation), and the circle-equivalent diameter and the circularity are calculated by using the following equations.

$$A=(B/\pi)^{1/2}\times2$$

$$ci=Lb/Ib$$

Where "A" is circle-equivalent diameter, and "B" is Projected area of a particle. The "projected area of a particle" is defined as an area of a binarized toner particle image. "ci" is Circularity, "Lb" is circumferential length of a circle having the same area as that of the projected area of a particle, and "Ib" is circumferential length of the projected image of a particle. The "circumferential length of the projected image of a particle" is defined as a length of a borderline drawn by connecting edge points of the toner particle image.

The circularity in the present invention is an indication for the degree of irregularities of a toner particle. If the toner particle is of a complete spherical shape, the circularity is equal to 1.000. The more complicated the surface shape, the lower the value for the circularity.

In addition, an average circularity C which means an average value of a circularity frequency distribution is calculated from the following equation where ci denotes a circularity (center value) at a division point i in the particle size distribution and fci denotes a frequency.

$$C = \sum_{i=1}^{m} (ci \times fci) \Big/ \sum_{i=1}^{m} (fci)$$

A specific measurement method is as follow. 10 ml of ion-exchange water from which an impurity solid or the like has been removed in advance is charged into a vessel, and a surfactant as a dispersant, preferably an alkyl benzene sulfonate, is added to the ion-exchange water. After that, 0.02 g of a measurement sample is further added to be uniformly dispersed in the mixture. The resultant mixture is subjected to dispersion treatment for 2 minutes by using an ultrasonic dispersing apparatus "Tetora 150" (manufactured by Nikkaki-Bios) as a dispersing means to prepare a dispersion for measurement. At that time, the dispersion is cooled as appropriate to prevent the temperature of the dispersion from reaching 40° C. or more.

The flow type particle image measuring device is used for shape measurement of the toner particles. The concentration of the dispersion is readjusted in such a manner that a concentration of color toner particles upon the measurement may be in the range of 3,000 to 10,000 particles/μl. Then, 1,000 or more toner particles are measured. After the measurement, an average circularity of the toner particles is determined by using the obtained data while cutting off data for particles each having a particle diameter of less than 2 μm.

Permeability in 45 vol % Aqueous Solution of Methanol (i) Preparation of Toner Dispersion An aqueous solution with a methanol-to-water volume mixing ratio of 45:55 is prepared. 10 ml of the aqueous solution is charged into a 30 ml sample bottle (Nichiden-Rika Glass Co., Ltd: SV-30), and 20 mg of the toner is immersed into the liquid surface, followed by capping the bottle. After that, the bottle is shaken with Yayoi shaker (model: YS-LD) at 150 swing/min. At this time, the angle at which the bottle is shaken is set as follows. A direction right above the shaker (vertical direction) is set to 0°, and a shaking support moves forward by 15° and backward by 20°. The shaking support is shaken forward and backward one at a swing. The swing is counted and as one swing when the shaking support goes forward from 0°, backward, and return to 0°.

The sample bottle is fixed to a fixing holder (prepared by fixing the cap of the sample bottle onto an extension line of the center of the support) attached to the tip of the support. After the sample bottle has been taken, a dispersion after 30 seconds of still standing is provided as a liquid for measurement.

(ii) Permeability (%) Measurement

The liquid prepared in (i) is charged into a 1 cm square quartz cell. A permeability (%) of light of a wavelength of 600 nm in the liquid is determined by using a spectrophotometer MPS 2000 (manufactured by Shimadzu Corporation) 10 minutes after the cell has been loaded into the spectrophotometer. The permeability (%) can be determined from the following equation.

$$\text{Permeability (\%)} = I/I_0 \times 100$$

(In the equation, $I_0$ denotes incident luminous flux, and I denotes transmitted luminous flux.)

Measurement of Frictional Charge Amount of Toner

A frictional charge amount of the toner of the present invention can be measured according to the method described below. First of all, the toner and magnetic carries are mixed in such a manner that the mass of the toner will be 5 mass % to thereby prepare a developer, followed by mixing the developer in a turbler mixer for 120 seconds. Then, the developer is charged into a metal vessel equipped with a 635-mesh conductive screen at its bottom, and is sucked by a suction apparatus. Then, a difference in mass between the developer before the suction and that after the suction and an electric potential stored in a condenser connected to the vessel are measured. At this time, a suction pressure is set to 250 $mmH_2O$. The frictional charge amount of the toner is calculated from the difference in mass, the stored electric potential, and the capacity of the condenser by using the following equation.

$$Q(mC/kg) = (C \times V)/(W1 - W2)$$

(In the equation, W1 denotes the mass (kg) of the developer before the suction, W2 denotes the mass (kg) of the developer after the suction, C denotes the capacity of the condenser, and V denotes the electric potential stored in the condenser.)

Measurement of BET Specific Surface Area of Toner

According to the BET method, nitrogen gas is adsorbed to the sample surface by using a specific surface area measuring device Autosorb 1 (manufactured by Yuasa Ionics Inc), and a specific surface area is calculated by using the BET multipoint method. It should be noted that the sample in a sample tube is subjected to evacuation for 5 hours prior to the measurement of the specific surface area.

Measurement of Acid Value (JIS Acid Value)

An acid value can be measured in compliance with JIS K 0070-1966. 2 to 10 g of a sample such as a binder resin is weighted in a 200 to 300 ml triangular flask. Then, about 50 ml of a methanol-toluene solvent mixture with a methanol-to-toluene mixing ratio of 30:70 is added to dissolve the resin. A small amount of acetone may be added if the solubility is poor. The resultant solution is titrated with a previously standardized 0.1 mol/l potassium hydroxide-alcohol solution by using a 0.1% mixed indicator of bromothymol blue and phenol red. Then, the acid value is determined from the consumption of the potassium hydroxide-alcohol solution by using the following equation.

$$\text{Acid Value} = \text{KOH (ml)} \times N \times 56.1/\text{Sample Mass (g)}$$

(where N denotes a factor of 0.1 mol/l KOH.)

Measurement of Molecular Weight by GPC (Binder Resin, Resin for Forming Coating Layer, or the Like)

A molecular weight of a chromatogram by gel permeation chromatography (GPC) is measured under the following conditions.

A column is stabilized in a heat chamber at 40° C. Tetrahydrofuran (THF) as a solvent is allowed to flow into the column at the temperature at a flow rate of 1 ml/min. 50 to 200 μl of a THF sample solution of a resin with a sample concentration adjusted to be within the range of 0.05 to 0.6 mass % is injected for measurement. An RI (refractive index) detector is used as a detector. It is recommended that multiple commercially available polystyrene gel columns be combined to be used as the column in order to precisely measure the molecular weight range of $10^3$ to $2\times10^6$. Preferable examples of the combination include; a combination of β-styragel 500, 103, 104, and 105 (manufactured by Waters Corporation); and a combination of shodex KA-801, 802, 803, 804, 805, 806, and 807 (manufactured by Showa Denko K. K.).

In measuring the molecular weight of a sample, the molecular weight distribution of the sample is calculated from the relationship between a logarithmic value of a calibration curve prepared by several kinds of monodisperse polystyrene standard samples and the number of counts. Examples of available polystyrene standard samples for preparing a calibration curve include samples manufactured by Pressure Chemical Co. or by Toyo Soda Manufacturing Company, Ltd. having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$. At least ten polystyrene standard samples are suitably used.

A specific example of conditions for measuring molecular weights of waxes by GPC is shown below.

Measurement of Molecular Weight by GPC (Waxes)

| GPC Measurement Conditions | |
|---|---|
| Device: | GPC-150 (Waters Corporation) |
| Column: | GMH-HT 30 cm double (manufactured by Tosoh Corporation) |
| Temperature: | 135° C. |
| Solvent: | o-dichlorobenzene (added with 0.1% ionol (manufactured by Shell Chemicals Japan Ltd.)) |
| Flow Rate: | 1.0 ml/min |
| Sample: | 0.4 ml of a 0.15% sample is injected |

Measurement is performed under the above conditions, and a molecular weight calibration curve prepared by monodisperse polystyrene standard samples is used in calculating the molecular weight of the sample. Furthermore, the molecular weight of the sample is calculated by GPC by subjecting the molecular weight to polyethylene conversion by using a conversion equation derived from the Mark-Houwink viscosity equation.

Measurement of Largest Endothermic Peak of Wax and Toner

The largest endothermic peak of a wax and a toner can be measured in compliance with ASTM D 3418-82 by using a differential scanning calorimetry measuring device (DSC measuring device) DSC 2920 (manufactured by TA Instruments Japan).

A measurement method is as follows. 5 to 20 mg, preferably 10 mg of a measurement sample is precisely weighted. The sample is charged into an aluminum pan, and measurement is performed in the measurement temperature range of 30 to 200° C., at a heating rate of 10° C./min, and under normal temperature and normal humidity by using an empty pan as a reference. During the heating process, an endothermic peak in the temperature range of 30 to 200° C. can be obtained. If multiple peaks exist, an endothermic peak with the highest height measured from a baseline in the range above the endothermic peak originating from the resin is defined as the largest endothermic peak.

Measurement of Particle Diameters of Magnetic Carrier

Particle diameters of magnetic carrier particles are measured as follows. 300 or more magnetic carrier particles each having a particle diameter of 0.1 μm or more are randomly sampled with a scanning electron microscope (platinum-evaporated, with an applied voltage of 2.0 kV and a magnification of ×5,000). Then, a number average horizontal Feret's diameter of the magnetic carrier particles is determined with a digitizer to be provided as a number average particle diameter of the carriers.

Measurement of Particle Diameters of Magnetic Materials and Inorganic Fine Particles in Magnetic Carrier Particle diameters of magnetic materials and inorganic fine particles are measured as follows. 300 or more particles each having a particle diameter of 5 nm or more are randomly sampled from cross sections obtained by cutting carriers with a microtome with a scanning electron microscope (platinum-evaporated, with an applied voltage of 2.0 kV and a magnification of ×50,000). Lengths of the major axis and minor axis of each particle are measured with a digitizer, and an average of the lengths is defined as a particle diameter. A particle diameter at which a particle size distribution (derived from a histogram of a column sectioned at 10 nm) of 500 or more particles shows a peak is calculated as a number average particle diameter. Therefore, multiple number average particle Diameters may exist in the particle diameter measurement.

Measurement of Particle Diameters of Fine Particles and Inorganic Fine Particles at Toner Surface Particle diameters of fine particles and inorganic fine particles are measured as follows. 500 or more particles each having a particle diameter of 1 nm or more are randomly sampled with a scanning electron microscope (platinum-evaporated, with an applied voltage of 2.0 kV and a magnification of ×50,000). Lengths of the major axis and minor axis of each particle are measured with a digitizer, and an average of the lengths is defined as a particle diameter. A particle size distribution of the inorganic fine particles or the fine particles (derived from a histogram of a column sectioned at 10 nm) is determined on the basis of the defined particle diameter of each particle. In the present invention, a maximum value of the column which gives the greatest frequency in the particle size distribution is defined as "a main peak particle diameter".

Measurement of Intensity of Magnetization of Magnetic Carrier

The intensity of magnetization of a magnetic carrier can be determined from the magnetic properties and true specific gravity of the magnetic carrier. The magnetic properties of the magnetic carrier can be measured by using a vibration magnetic field-type magnetic property automatic recorder BHV-30 manufactured by Riken Denshi. Co., Ltd. A measurement method is as follows. A magnetic carrier is sufficiently closely packed in a cylindrical plastic container. Meanwhile, an external magnetic field of 1 kOe (79.6 kA/m)

is generated. In this state, the magnetic moment of each magnetic carrier packed in the container is measured. Furthermore, an actual mass of a magnetic carrier packed in the container is measured to determine the intensity of magnetization of each magnetic carrier ($Am^2/kg$)

The true specific gravity of a magnetic carrier particle can be determined with a dry type automatic densimeter Auto Pycnometer. The intensity of magnetization of a magnetic carrier ($kAm^2/m^3$) is determined by multiplying the intensity of magnetization ($Am^2/kg$) by the true specific gravity ($g/cm^3$).

EXAMPLES

Hereinafter, the present invention is described by way of specific examples. However, the present invention is not limited by these examples.

Hybrid Resin Production Example

Placed in a dropping funnel were 2.0 mol of styrene, 0.21 mol of 2-ethylhexyl acrylate, 0.14 mol of fumaric acid, 0.03 mol of a dimer of α-methylstyrene, and 0.05 mol of dicumyl peroxide as materials for a vinyl-based polymer unit. Placed in a 4 l four-necked flask made of glass were 7.0 mol of polyoxypropylene(2.2)-2,2-bis(4-hydroxyphenyl)propane, 3.0 mol of polyoxyethylene(2.2)-2,2-bis(4-hydroxyphenyl) propane, 3.0 mol of terephthalic acid, 1.9 mol of trimellitic anhydride, 5.0 mol of fumaric acid, and 0.2 g of dibutyltin oxide as materials for a polyester unit. A thermometer, a stirring bar, a condenser, and a nitrogen introducing pipe were installed on the four-necked flask, and the four-necked flask was placed in a mantle heater. Subsequently, air in the four-necked flask was substituted by nitrogen gas, and the four-necked flask was gradually heated while the mixture in the four-necked flask was stirred. Then, the monomers for a vinyl-based polymer unit and a polymerization initiator were dropped from the dropping funnel for 4 hours to the four-necked flask while the mixture in the four-necked flask was stirred at 145° C. Next, the mixture in the four-necked flask was heated to 200° C., and was reacted for 4 hours to yield a hybrid resin. Table 1 shows the molecular weight measurements by GPC of the hybrid resin.

Polyester Resin Production Example

Placed in a 4 l four-necked flask made of glass were 3.6 mol of polyoxypropylene(2.2)-2,2-bis(4-hydroxyphenyl) propane, 1.6 mol of polyoxyethylene(2.2)-2,2-bis(4-hydroxyphenyl)propane, 1.7 mol of terephthalic acid, 1.4 mol of trimellitic anhydride, 2.4 mol of fumaric acid, and 0.12 g of dibutyltin oxide. A thermometer, a stirring bar, a condenser, and a nitrogen introducing pipe were installed on the four-necked flask, and the four-necked flask was placed in a mantle heater. The mixture in the four-necked flask was reacted for 5 hours at 215° C. in a nitrogen atmosphere to yield a polyester resin. Table 1 shows the molecular weight measurements by GPC of the polyester resin.

Styrene-Acrylic Resin Production Example

| | |
|---|---|
| Styrene | 70 parts by mass |
| n-butyl acrylate | 24 parts by mass |
| Monobutyl maleate | 6 parts by mass |
| Di-t-butylperoxide | 1 part by mass |

Air in a four-necked flask was sufficiently substituted by nitrogen while 200 parts by mass of xylene was stirred in the four-necked flask. After xylene in the four-necked flask had been heated to 120° C., the above components were dropped for 3.5 hours to the four-necked flask. Furthermore, polymerization was completed under xylene reflux, followed by removal of a solvent by distillation under reduced pressure to yield a styrene-acrylic resin. Table 1 shows the molecular weight measurements by GPC of the styrene-acrylic resin.

TABLE 1

| | Molecular Weight Measurements (GPC) | | | |
|---|---|---|---|---|
| | Mw ($\times 10^3$) | Mn ($\times 10^3$) | Mp ($\times 10^3$) | Mw/Mn (–) |
| Hybrid Resin | 81.5 | 3.1 | 15.5 | 26.29 |
| Polyester Resin | 26.6 | 3.6 | 7.6 | 7.39 |
| Styrene-Acrylic Resin | 72.0 | 6.9 | 15.0 | 10.43 |

Carrier Production Example 1

Metal oxide particles of $Fe_2O_3$, CuO, and ZnO were weighted in such a manner that molar ratios of $Fe_2O_3$, CuO, and ZnO would be 50 mol %, 25 mol %, and 25 mol %, respectively. Then, the metal oxide particles were mixed in a ball mill. After the resultant powder mixture had been calcined, the powder mixture was pulverized with the ball mill and was then granulated with a spray dryer. The granulated products were sintered and classified to produce magnetic particles.

Furthermore, the surface of each of the magnetic particles produced as described above was coated with a thermosetting silicone resin according to the following method. A carrier coating solution containing 10 mass % of a silicone coating resin was prepared by using toluene as a solvent in such a manner that a silicone coating resin amount at the magnetic particle surface would be 1.0 part by mass with respect to magnetic particles at the time of coating.

The magnetic particles were charged into the carrier coating solution, and the solvent was volatilized at 70° C. while a shearing stress was continuously applied to the solution. Then, the magnetic particle surface was coated with the silicone resin.

The silicone resin-coated magnetic particles were heat-treated by stirring the magnetic particles at 200° C. for 3 hours. After that, the magnetic particles were cooled, crushed, and classified with a 200-mesh sieve to produce Carrier 1 having a number average particle diameter of 52 μm, a true specific gravity of 5.02 $g/cm^3$, and an intensity of magnetization of 301 $kAm^2/m^3$.

Carrier Production Example 2

4.0 mass % of a silane-based coupling agent (3-(2-aminoethylaminopropyl)trimethoxysilane) was added to each of magnetite powder having a number average particle diameter of 0.25 μm and hematite powder having a number average particle diameter of 0.60 μm. The above components were mixed and stirred in a vessel at a high speed above 100° C., and each fine particle was treated.

| | |
|---|---|
| Phenol | 10 parts by mass |
| Formaldehyde solution (40% of formaldehyde, 10% of methanol, and 50% of water) | 6 parts by mass |
| Treated magnetite | 75 parts by mass |
| Treated hematite | 9 parts by mass |

The above materials, 5 parts by mass of 28% ammonia water, and 20 parts by mass of water were placed in a flask. The mixture was heated to 85° C. within 30 minutes and held at the temperature while the mixture was stirred and mixed. The mixture was subjected to a polymerization reaction for 3 hours, and the yielded phenol resin was cured. After that, the contents in the flask were cooled to 30° C., and furthermore, water was added. Then, a supernatant was removed, and a precipitate was washed with water and air-dried. Subsequently, the precipitate was dried at 60° C. under reduced pressure (5 mmHg or less) to produce spherical magnetic resin particles in which magnetic materials were dispersed.

Furthermore, in the same manner as in Carrier Production Example 1, the surface of each of the magnetic resin particles produced as described above was coated with a thermosetting silicone resin according to the following method. That is, a carrier coating solution containing 10 mass % of a silicone coating resin was prepared by using toluene as a solvent in such a manner that a silicone coating resin amount at the resin particle surface would be 1.0 part by mass with respect to the magnetic resin particles at the time of coating.

The magnetic resin particles were charged into the carrier coating solution, and the solvent was volatilized at 70° C. while a shearing stress was continuously applied to the solution. Then, the magnetic resin particle surface was coated with the silicone resin.

The silicone resin-coated magnetic resin particles were heat-treated by stirring the magnetic resin particles at 200° C. for 3 hours. After that, the magnetic resin particles were cooled, crushed, and classified with a 200-mesh sieve to produce Carrier 2 having a number average particle diameter of 32 μm, a true specific gravity of 3.55 g/cm$^3$, and an intensity of magnetization of 189 kAm$^2$/m$^3$.

Carrier Production Example 3

The surfaces of the magnetic resin particles in Carrier Production Example 2 were coated according to the following method to produce Carrier 3.

Used as a coating material was a copolymer (with a copolymerization ratio of 8:1 and a weight average molecular weight of 45,000) of methyl methacrylate and a methyl methacrylate ester to which a perfluoroalkyl group represented by the formula (3) (m=7, n=2) is bonded via ester linkage. A carrier coating solution containing 10 mass % of the methyl methacrylate copolymer was prepared by using a solvent mixture of methyl ethyl ketone and toluene as a solvent in such a manner that the amount of the coating material would be 2 parts by mass with respect to 100 parts by mass of the magnetic resin particles at the time of coating.

The magnetic resin particles were charged into the carrier coating solution, and the solvent was volatilized at 70° C. while a shearing stress was continuously applied to the solution. Then, the magnetic resin particle surface was coated with the methyl methacrylate copolymer.

The methyl methacrylate copolymer-coated magnetic resin particles were heat-treated by stirring the magnetic resin particles at 100° C. for 2 hours. After that, the magnetic resin particles were cooled, crushed, and classified with a 200-mesh sieve to produce Carrier 3 having a number average particle diameter of 32 μm, a true specific gravity of 3.53 g/cm$^3$, and an intensity of magnetization of 186 kAm$^2$/m$^3$.

Carrier Production Example 4

The surfaces of the magnetic particles in Carrier Production Example 1 were coated according to the following method to produce Carrier 4.

A coating material to be used was a dispersion prepared as follows. 10 parts by mass of melamine particles each having a particle diameter of 230 nm and 6 parts by mass of carbon particles each having a specific resistance of 1×10-2 Ωcm and a particle diameter of 30 nm were added to 100 parts by mass of the coating material in Carrier Production Example 3. Then, the mixture was dispersed with an ultrasonic dispersing apparatus for 30 minutes to prepare a dispersion. A carrier coating solution containing 10 mass % of the coating material was prepared by using a solvent mixture of methyl ethyl ketone and toluene as a solvent in such a manner that the amount of the coating material would be 2.5 parts by mass with respect to the magnetic particles at the time of coating.

The magnetic particles were charged into the carrier coating solution, and the solvent was volatilized at 70° C. while a shearing stress was continuously applied to the solution. Then, the magnetic particle surface was coated with the coating material.

The magnetic particles coated with the coating material were heat-treated by stirring the magnetic particles at 100° C. for 2 hours. After that, the magnetic particles were cooled, crushed, and classified with a 200-mesh sieve to produce Carrier 4 having a number average particle diameter e of 33 μm, a true specific gravity of 3.53 g/cm$^3$, and an intensity of magnetization of 185 kAm$^2$/m$^3$.

Carrier Production Example 5

| | |
|---|---|
| Phenol | 10 parts by mass |
| Formaldehyde solution (40 mass % of formaldehyde, 10 mass % of methanol, and 50 mass % of water) | 6 parts by mass |
| Treated magnetite | 50 parts by mass |
| Treated hematite | 34 parts by mass |

The above materials, 5 parts by mass of 28% ammonia water, and 18 parts by mass of water were placed in a flask. The mixture was heated to 85° C. within 30 minutes and held at the temperature while the mixture was stirred and mixed. The mixture was subjected to a polymerization reaction for 3 hours, and a yielded phenol resin was cured. After that, the contents in the flask were cooled to 30° C., and furthermore, water was added. Then, a supernatant was removed, and a precipitate was washed with water and air-dried. Subsequently, the precipitate was dried at 60° C. under reduced pressure (5 mmHg or less) to produce spherical magnetic resin particles in which magnetic materials were dispersed.

The thermosetting silicone resin used for Carrier 1 was used as a coating material. 6 parts by mass of oxygen deficient tin oxide particles each having a specific resistance of 2×10$^4$ Ωcm and a particle diameter of 380 nm were added to 100 parts by mass of the coating material, and the whole was dispersed with an ultrasonic dispersing apparatus for 30 minutes. A carrier coating solution containing 10 mass % of the coating material was prepared by using toluene as a solvent in such a manner that the amount of the coating material would be 2.5 parts by mass with respect to the magnetic resin particles at the time of coating.

The magnetic resin particles were charged into the carrier coating solution, and the solvent was volatilized at 70° C. while a shearing stress was continuously applied to the solution. Then, the magnetic resin particle surface was coated with the silicone resin.

The silicone resin-coated magnetic resin particles were heat-treated by stirring the magnetic resin particles at 200° C. for 3 hours. After that, the magnetic resin particles were cooled, crushed, and classified with a 200-mesh sieve to produce Carrier 5 having a number average particle diameter of 28 μm, a true specific gravity of 3.51 g/cm$^3$, and an intensity of magnetization of 131 kAm$^2$/m$^3$.

Example 1

| | |
|---|---|
| Hybrid resin | 100 parts by mass |
| Wax A shown in Table 2 below | 5 parts by mass |
| Aluminum compound of 1,4-di-t-butylsalicylate | 0.5 parts by mass |
| C.I. Pigment Blue 15:3 | 5 parts by mass |

After the above prescribed materials had been sufficiently mixed in Henschell Mixer (FM-75, manufactured by Mitsui Miike Kakoki), the mixture was kneaded in a biaxial extruder (PCM-30, manufactured by Ikegai Iron Works) set to 130° C. The resultant kneaded product was cooled and roughly pulverized with a hammer mill to obtain roughly pulverized products each having a diameter of 1 mm or less. The resultant roughly pulverized products were finely pulverized with a collision type air-jet pulverizer using a high pressure gas. The resultant finely pulverized products had a weight average particle diameter of 4.9 μm, a number average particle diameter of 3.8 μm, and an average circularity of 0.915.

Table 2 shows releasing agents used in this example and in examples and comparative examples described below.

TABLE 2

| | Largest Endothermic Peak Temperature (° C.) | Kind of Wax |
|---|---|---|
| Wax A | 83.0 | Refined Fischer-Tropsch |
| Wax B | 65.0 | Refined Normal Paraffin |
| Wax C | 75.0 | Refined Normal Paraffin |
| Wax D | 105.0 | Fischer-Tropsch |
| Wax E | 110.0 | Polyethylene |
| Wax F | 60.0 | Refined Normal Paraffin |

Next, the resultant finely pulverized products were subjected to surface treatment as follows by using a surface modifying apparatus shown in FIGS. 1 and 2. 1.3 kg of the resultant finely pulverized products were loaded into the surface modifying apparatus at a time and were subjected to the surface treatment for 70 seconds with the number of revolutions of the dispersing rotor 6 set to 5,800 rpm (a rotating peripheral speed of the dispersing rotor 6 was set to 130 m/sec) while fine particles were removed with the number of revolutions of the classifying rotor 1 set to 7,300 rpm (after the completion of the loading of the finely pulverized products from the raw material supply port 3, the finely pulverized products were subjected to treatment for 70 seconds and were then taken as treated products by opening a discharge valve 8).

At that time, in this example, ten square disks 10 were placed on an upper part of the dispersing rotor 6. A space between the guide ring 9 and each of the ten square disks 10 on the dispersing rotor 6 was set to 30 mm, and a space between the dispersing rotor 6 and the liner 4 was set to 5 mm. A blower air quantity was set to 14 m$^3$/min, and the temperature of the coolant to be passed through the jacket and the temperature T1 of cold air were each set to −20° C.

The surface modifying apparatus was operated for 20 minutes in this state. As a result, the temperature T2 of the next position of the classifying rotor 1 was stabilized at 27° C. Cyan toner particles obtained after the surface treatment had a weight average particle diameter of 5.3 μm, a number average particle diameter of 4.8 μm, and an average circularity of 0.954. A classification yield of the cyan toner particles was 82%.

Furthermore, a woven metal wire with a diameter of 30 cm, an aperture of 29 μm, and an average wire diameter of 30 μm was installed on a net surface-fixing type air sieve Highbolter (NR-300, manufactured by Shin Tokyo Machinery: an air brush was attached to the back side of the woven metal wire). Cyan toner powder carried by an air stream with an air quantity of 5 Nm$^3$/min was supplied to the woven metal wire to result in cyan toner particles from which coarse grains had been separated. The ratio of particles having a weight average particle diameter of 12.7 μm or more to the resultant cyan toner particles was less than 0.1 vol %. In addition, the ratio of the separated coarse grains to the cyan toner particles which had passed through the sieve was about 0.2 mass %.

1.0 part by mass of hydrophobized titanium oxide having a main peak particle diameter of 40 nm and 1.5 parts by mass of amorphous silica having a main peak particle diameter of 110 nm were externally added to and mixed with 100 parts by mass of the resultant cyan toner particles to obtain a cyan toner. The resultant cyan toner had a weight average particle diameter of 5.4 μm, a number average particle diameter of 4.9 μm, and an average circularity of 0.935. The measured BET specific surface area of the resultant cyan toner was 2.80 m$^2$/g. Furthermore, the measured permeability of light of a wavelength of 600 nm in a liquid prepared by dispersing 20 mg of the above cyan toner in a 45 vol % aqueous solution of methanol was 62%. In addition, main peak particle diameters of the inorganic fine particles (the above titanium oxide and amorphous silica) were 40 nm and 110 nm, respectively.

7 parts by mass of the cyan toner and 93 parts by mass of Carrier 1 were mixed in a turbler mixer to prepare a developer. The measured frictional charge amount of the resultant developer was −38.1 mC/kg.

Image output evaluation was carried out under normal temperature and normal humidity (23° C., 60% RH) by using the developer and a remodeled device of a full-color copying machine CLC 5000 manufactured by Canon (a device obtained by subjecting CLC 5000 to modifications including: narrowing a laser spot size; enabling CLC 5000 to output an image at 600 dpi; replacing the surface layer of a fixing roller in a fixing unit with a silicone tube; and removing an oil application mechanism). The items and criteria of the image output evaluation are listed below.

(1) Dot Reproducibility

A halftone image was formed by means of the toner and the remodeled device. Then, the image was visually observed and evaluated for dot reproducibility on the basis of the following criteria. The formed halftone image is a halftone image with the 48th density in 256 gradation display where 0 corresponds to solid white and 255 corresponds to solid black.

A: The image provides no feeling of roughness and is smooth.

B: The image provides limited feeling of roughness.

C: The image provides some degree of feeling of roughness, which is at a practically acceptable level.

D: The image provides feeling of roughness, which becomes a problem.

E: The image provides extremely high degree of feeling of roughness.

(2) Scattering

A horizontal line pattern in which 4-dot horizontal lines were printed at intervals of 176 dot spaces was visually observed, and toner scattering in the image was evaluated on the basis of the following criteria.

A: No scattering is observed.

B: A low level of scattering is observed.

C: An acceptable level of scattering is observed.

D: Scattering which causes variations in line thickness is observed.

E: Scattering which stains a space between lines is observed.

(3) Developability

Measured was a contrast potential necessary to achieve a toner loading on transfer paper of a solid image of 0.6 $mg/cm^2$ when forming the solid image by means of the toner and the remodeled device. The lower the potential, the more satisfactory the developability.

(4) Image Density

Measured was an image density of a fixed image when the solid image was fixed at 180° C. The measurement was performed with a color reflection densitometer (X-RITE 404A manufactured by X-Rite Co.).

(5) Gloss

A gloss of the fixed image was measured by using VG-10 glossmeter (manufactured by Nihon Denshoku) as a measuring device and each solid image used for the image density measurement as a sample.

The measurement was performed as follows. First, an applied voltage to a light source was set to 6 V with a voltage stabilizer. Then, a projection angle and a light receiving angle were each set to 60°. By using zero adjustment and a standard plate, the sample image was placed on a sample base after standard setting. Furthermore, 3 sheets of white paper were overlaid on the sample image to perform the measurement. A numerical value shown on a gauge was read in % units.

At this time, an S, S/10 selector switch was adjusted to S and an angle, sensitivity selector switch was adjusted to 45–60. Used was a fixed image sample in which a toner loading on paper before fixing was adjusted to 0.6±0.1 $mg/cm^2$.

(6) Transfer Efficiency

Transfer efficiency was measured as follows. A solid black image was formed on a photosensitive drum. Then, the solid black image was collected with transparent adhesive tape, and an image density (D1) of the solid black image was measured with a color reflection densitometer (X-RITE 404A manufactured by X-Rite Co.). Subsequently, a solid black image was formed on the photosensitive drum again and was transferred onto paper. Then, the solid black image transferred onto paper was collected with transparent adhesive tape, and an image density (D2) of the solid black image was measured. The transfer efficiency was calculated from the resultant image densities (D1) and (D2) based on the following equation.

$$\text{Transfer Efficiency } (\%) = (D2/D1) \times 100$$

(7) Fixing Range

A fixing device was removed from the remodeled device. The solid image was fixed by changing the heating temperature in the fixing device from 100° C. in 10° C. increments. Then, a temperature range in which the solid image was fixed was measured. A lower limit temperature was defined as a temperature (cold offset) at which a toner was not transferred onto white paper when the white paper was passed immediately after the solid image had been passed through the fixing device. An upper limit temperature was defined as a temperature 10° C. lower than a temperature (hot offset) at which the gloss started to decrease when the gloss measurement was performed at each temperature. A range between the lower limit temperature and the upper limit temperature was defined as a fixing range.

In this example, dot reproducibility in a halftone image was satisfactory. In addition, scattering was slightly observed, which was satisfactory. A fixability test was performed for measuring the fixing range. As a result, the solid image was fixed at 130° C. and hot offset occurred at 210° C. Therefore, the fixing range extended from 130° C. to 200° C.

Furthermore, a 10,000-sheet endurance test by a 7% chart was performed. The dot reproducibility, the scattering, the frictional charge amount of the toner, the developability, and the transfer efficiency were evaluated in the same manners as those described above at an early stage of the endurance test and after the endurance test.

As a result, a variation in charge amount due to carrier spent was not observed so much and nearly no variation in developability was observed. In addition, a high-quality image with low fogging was obtained.

Table 3 shows the prescription of the toner particles used. Table 4 shows the physical properties of the toner particles and carrier particles. Table 5 shows the test results of the developer.

Example 2

The same prescribed materials as those used in Example 1 were mixed and then kneaded. The resultant kneaded product was roughly pulverized in the same manner as in Example 1. The resultant roughly pulverized products were pulverized into finely pulverized products in the same manner as in Example 1 except that the pressure of the high-pressure gas in the collision type air-jet pulverizer was slightly lowered. The resultant finely pulverized products had a weight average particle diameter of 5.8 μm, a number average particle diameter of 4.8 μm, and an average circularity of 0.913.

Next, the finely pulverized products were subjected to surface treatment in the same manner as in Example 1 except that the number of revolutions of the classifying rotor 1 was set to 6,800 rpm. Cyan toner particles obtained after the surface treatment had a weight average particle diameter of 6.1 μm, a number average particle diameter of 5.5 μm, and an average circularity of 0.932. A classification yield of the cyan toner particles was 89%.

Coarse grains were separated from the cyan toner particles in the same manner as in Example 1. 0.8 parts by mass of hydrophobized alumina having a main peak particle diameter of 60 nm and 1.2 parts by mass of amorphous silica having a main peak particle diameter of 90 nm were externally added to and mixed with 100 parts by mass of the resultant cyan toner particles to obtain a cyan toner. The resultant cyan toner had a weight average particle diameter of 6.2 μm, a number average particle diameter of 5.5 μm, an average circularity of 0.932, and a BET specific surface area of 2.10 $m^2/g$. Furthermore, the measured permeability of light of a wavelength of 600 nm in a liquid prepared by dispersing 20 mg of the above cyan toner in a 45 vol % aqueous solution of methanol was 54%. In addition, main peak particle diameters of the inorganic fine particles (the above alumina and amorphous silica) were 60 nm and 90 nm, respectively.

6 parts by mass of the cyan toner and 94 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 3

The same prescribed materials as those used in Example 1 were mixed and then kneaded. The resultant kneaded product was roughly pulverized in the same manner as in Example 1. The resultant roughly pulverized products were pulverized into finely pulverized products in the same manner as in Example 1 except that the pressure of the high-pressure gas in the collision type air-jet pulverizer was heightened. The resultant finely pulverized products had a weight average particle diameter of 3.0 μm, a number average particle diameter of 2.4 μm, and an average circularity of 0.917.

Next, the finely pulverized products were subjected to surface treatment in the same manner as in Example 1 except that the number of revolutions of the classifying rotor 1 was set to 7,800 rpm. Cyan toner particles obtained after the surface treatment had a weight average particle diameter of 3.3 μm, a number average particle diameter of 2.6 μm, and an average circularity of 0.930. A classification yield of the cyan toner particles was 76%.

Coarse grains were separated from the cyan toner particles in the same manner as in Example 1. 1.3 parts by mass of hydrophobized titanium oxide having a main peak particle diameter of 30 nm and 2.5 parts by mass of amorphous silica having a main peak particle diameter of 110 nm were externally added to and mixed with 100 parts by mass of the resultant cyan toner particles to obtain a cyan toner. The resultant cyan toner had a weight average particle diameter of 3.3 μm, a number average particle diameter of 2.6 μm, an average circularity of 0.931, and a BET specific surface area of 3.49 $m^2/g$. Furthermore, the measured permeability of light of a wavelength of 600 nm in a liquid prepared by dispersing 20 mg of the above cyan toner in a 45 vol % aqueous solution of methanol was 76%. In addition, main peak particle diameters of the inorganic fine particles (the above titanium oxide and amorphous silica) were 30 nm and 110 nm, respectively.

4.5 parts by mass of the cyan toner and 95.5 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 4

The same prescribed materials as those used in Example 1 were mixed and then kneaded. The resultant kneaded product was roughly pulverized, the resultant roughly pulverized products were pulverized into finely pulverized products, in the same manner as in Example 1. The resultant finely pulverized products had a weight average particle diameter of 4.9 μm, a number average particle diameter of 3.7 μm, and an average circularity of 0.916.

Next, the finely pulverized products were subjected to surface treatment in the same manner as in Example 1 except that the number of revolutions of the dispersing rotor 6 was set to 4,500 rpm and time period for the surface treatment at a time was set 45 seconds. Cyan toner particles obtained after the surface treatment had a weight average particle diameter of 5.4 μm, a number average particle diameter of 4.8 μm, and an average circularity of 0.921. A classification yield of the cyan toner particles was 85%.

Coarse grains were separated from the cyan toner particles in the same manner as in Example 1. 0.9 parts by mass of amorphous silica having a main peak particle diameter of 20 nm and 1.5 parts by mass of alumina having a main peak particle diameter of 90 nm were externally added to and mixed with 100 parts by mass of the resultant cyan toner particles to obtain a cyan toner. The resultant cyan toner had a weight average particle diameter of 5.4 μm, a number average particle diameter of 4.8 μm, an average circularity of 0.921, and a BET specific surface area of 2.98 $m^2/g$. Furthermore, the measured permeability of light of a wavelength of 600 nm in a liquid prepared by dispersing 20 mg of the above cyan toner in a 45 vol % aqueous solution of methanol was 36%. In addition, main peak particle diameters of the inorganic fine particles (the above amorphous silica and alumina) were 20 nm and 90 nm, respectively.

7 parts by mass of the cyan toner and 93 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 5

The same prescribed materials as those used in Example 1 were mixed and then kneaded. The resultant kneaded product was roughly pulverized, the resultant roughly pulverized products were pulverized into finely pulverized products, in the same manner as in Example 1. The resultant finely pulverized products had a weight average particle diameter of 4.8 μm, a number average particle diameter of 3.9 μm, and an average circularity of 0.915.

Next, the finely pulverized products were subjected to surface treatment in the same manner as in Example 1 except that the number of revolutions of the dispersing rotor 6 was set to 6,500 rpm. Cyan toner particles obtained after the surface treatment had a weight average particle diameter of 5.4 μm, a number average particle diameter of 4.4 μm, and an average circularity of 0.944. A classification yield of the cyan toner particles was 83%.

Coarse grains were separated from the cyan toner particles in the same manner as in Example 1. 0.8 parts by mass of titanium oxide having a main peak particle diameter of 40 nm and 1.5 parts by mass of amorphous silica having a main peak particle diameter of 110 nm were externally added to and mixed with 100 parts by mass of the resultant cyan toner particles to obtain a cyan toner. The resultant cyan toner had a weight average particle diameter of 5.4 μm, a number average particle diameter of 4.5 μm, an average circularity of 0.944, and a BET specific surface area of 2.30 $m^2/g$. Furthermore, the measured permeability of light of a wavelength of 600 nm in a liquid prepared by dispersing 20 mg of the above cyan toner in a 45 vol % aqueous solution of methanol was 79%. In addition, main peak particle diameters of the inorganic fine particles (the above titanium oxide and amorphous silica) were 40 nm and 110 nm, respectively.

7 parts by mass of the cyan toner and 93 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 6

1.0 parts by mass of hydrophobized amorphous silica having a main peak particle diameter of 30 nm and 2.0 parts by mass of oil-treated amorphous silica having a main peak particle diameter of 90 nm were externally added to and mixed with 100 parts by mass of the resultant cyan toner particles in the same manner as in Example 1 to obtain a cyan toner. The resultant cyan toner had a weight average particle diameter of 5.4 μm, a number average particle diameter of 4.5 μm, an average circularity of 0.934, and a BET specific surface area of 3.40 $m^2/g$. Furthermore, the measured permeability of light of a wavelength of 600 nm in a liquid prepared by dispersing 20 mg of the above cyan toner in a 45 vol % aqueous solution of methanol was 59%. In addition, main peak particle diameters of the inorganic fine particles (the above amorphous silicas) were 30 nm and 90 nm.

7 parts by mass of the cyan toner and 93 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 7

| | |
|---|---|
| Hybrid resin | 100 parts by mass |
| Wax B | 5 parts by mass |
| Aluminum compound of 1,4-di-t-butylsalicylate | 0.5 parts by mass |
| C.I. Pigment Blue 15:3 | 5 parts by mass |

The above prescribed materials had been mixed in the same manner as in Example 1 were mixed and then kneaded. The resultant kneaded product was roughly pulverized, the resultant roughly pulverized products were pulverized into finely pulverized products, in the same manner as in Example 1. The resultant finely pulverized products had a weight average particle diameter of 4.8 μm, a number average particle diameter of 3.7 μm, and an average circularity of 0.915.

Next, the finely pulverized products were subjected to surface treatment in the same manner as in Example 1. Cyan toner particles obtained after the surface treatment had a weight average particle diameter of 5.4 μm, a number average particle diameter of 4.7 μm, and an average circularity of 0.931. A classification yield of the cyan toner particles was 84%.

1.0 parts by mass of hydrophobized titanium oxide having a main peak particle diameter of 40 nm and 1.5 parts by mass of amorphous silica having a main peak particle diameter of 110 nm were externally added to and mixed with 100 parts by mass of the resultant cyan toner particles to obtain a cyan toner. The resultant cyan toner had a weight average particle diameter of 5.4 μm, a number average particle diameter of 4.8 μm, an average circularity of 0.930, and a BET specific surface area of 2.76 $m^2/g$. Furthermore, the measured permeability of light of a wavelength of 600 nm in a liquid prepared by dispersing 20 mg of the above cyan toner in a 45 vol % aqueous solution of methanol was 70%. In addition, main peak particle diameters of the inorganic fine particles (the above titanium oxide and amorphous silica) were 40 nm and 110 nm, respectively.

7 parts by mass of the cyan toner and 93 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 8

Wax A of Example 1 was replaced with Wax C, and the other materials were the same as those used in Example 1. Those materials were kneaded and pulverized in the same manner as in Example 1 to obtain finely pulverized products. The resultant finely pulverized products had a weight average particle diameter of 4.9 μm, a number average particle diameter of 3.7 μm, and an average circularity of 0.915.

Next, the finely pulverized products were subjected to surface treatment in the same manner as in Example 1. Cyan toner particles obtained after the surface treatment had a weight average particle diameter of 5.4 μm, a number average particle diameter of 4.6 μm, and an average circularity of 0.933. A classification yield of the cyan toner particles was 82%.

1.0 part by mass of hydrophobized titanium oxide having a main peak particle diameter of 40 nm and 1.5 parts by mass of amorphous silica having a main peak particle diameter of 110 nm were externally added to and mixed with 100 parts by mass of the resultant cyan toner particles to obtain a cyan toner. The resultant cyan toner had a weight average particle diameter of 5.4 μm, a number average particle diameter of 4.7 μm, an average circularity of 0.933, and a BET specific surface area of 2.73 $m^2/g$. Furthermore, the measured permeability of light of a wavelength of 600 nm in a liquid prepared by dispersing 20 mg of the above cyan toner in a 45 vol % aqueous solution of methanol was 54%. In addition, main peak particle diameters of the inorganic fine particles (the above titanium oxide and amorphous silica) were 40 nm and 110 nm, respectively.

7 parts by mass of the cyan toner and 93 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 9

Wax A of Example 1 was replaced with Wax D, and the other materials were the same as those used in Example 1. Those materials were kneaded and pulverized in the same manner as in Example 1 to obtain finely pulverized products. The resultant finely pulverized products had a weight average particle diameter of 5.2 μm, a number average particle diameter of 4.1 μm, and an average circularity of 0.912.

Next, the finely pulverized products were subjected to surface treatment in the same manner as in Example 1. Cyan toner particles obtained after the surface treatment had a weight average particle diameter of 5.7 μm, a number average particle diameter of 5.0 μm, and an average circularity of 0.927. A classification yield of the cyan toner particles was 80%.

1.0 part by mass of hydrophobized titanium oxide having a main peak particle diameter of 40 nm and 1.5 parts by mass of amorphous silica having a main peak particle diameter of 110 nm were externally added to and mixed with 100 parts by mass of the resultant cyan toner particles to obtain a cyan toner. The resultant cyan toner had a weight average particle diameter of 5.7 μm, a number average particle diameter of 5.1 μm, an average circularity of 0.926, and a BET specific surface area of 2.60 $m^2/g$. Furthermore, the measured permeability of light of a wavelength of 600 nm in a liquid prepared by dispersing 20 mg of the above cyan toner in a 45 vol % aqueous solution of methanol was 42%. In addition, main peak particle diameters of the inorganic fine particles (the above titanium oxide and amorphous silica) were 40 nm and 110 nm, respectively.

9 parts by mass of the cyan toner and 91 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 10

Hybrid resin of Example 1 was replaced with Polyester resin, and the other materials were the same as those used in Example 1. Those materials were kneaded and pulverized in the same manner as in Example 1 to obtain finely pulverized products. The resultant finely pulverized products had a weight average particle diameter of 5.1 μm, a number average particle diameter of 4.2 μm, and an average circularity of 0.915.

Next, the finely pulverized products were subjected to surface treatment in the same manner as in Example 1. Cyan toner particles obtained after the surface treatment had a weight average particle diameter of 5.7 μm, a number average particle diameter of 4.9 μm, and an average circularity of 0.930. A classification yield of the cyan toner particles was 83%.

1.0 part by mass of hydrophobized titanium oxide having a main peak particle diameter of 40 nm and 1.5 parts by mass of amorphous silica having a main peak particle diameter of 110 nm were externally added to and mixed with 100 parts by mass of the resultant cyan toner particles to obtain a cyan toner. The resultant cyan toner had a weight average particle diameter of 5.7 μm, a number average particle diameter of 4.9 μm, an average circularity of 0.930, and a BET specific surface area of 2.77 $m^2/g$. Furthermore, the measured permeability of light of a wavelength of 600 nm in a liquid prepared by dispersing 20 mg of the above cyan toner in a 45 vol % aqueous solution of methanol was 40%. In addition, main peak particle diameters of the inorganic fine particles (the above titanium oxide and amorphous silica) were 40 nm and 110 nm, respectively.

7 parts by mass of the cyan toner and 93 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 11

9 parts by mass of the cyan toner in Example 1 and 91 parts by mass of Magnetic Carrier 2 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 12

9 parts by mass of the cyan toner in Example 1 and 91 parts by mass of Magnetic Carrier 3 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 13

9 parts by mass of the cyan toner in Example 1 and 91 parts by mass of Magnetic Carrier 4 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

It was found that the developer is highly excellent in early-stage developability and provides extremely satisfactory developability with no carrier contamination due to prolonged use. It was also found that the developer provides high transfer efficiency both at an early stage and after the prolonged use and can prevent toner deterioration even when a toner excellent in low temperature fixability is used.

Example 14

10 parts by mass of the toner in Example 1 and 90 parts by mass of Magnetic Carrier 5 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 15

The pigment of Example 1 was replaced with 3 parts by mass of C.I. Pigment Red 122 and 2 parts by mass of C.I. Pigment Red 57, and the other materials were the same as those used in Example 1. Those materials were kneaded and pulverized in the same manner as in Example 1 to obtain finely pulverized products. The resultant finely pulverized products had a weight average particle diameter of 4.8 μm, a number average particle diameter of 3.6 μm, and an average circularity of 0.916.

Next, the resultant finely pulverized products were subjected to surface treatment in the same manner as in Example 1. Magenta toner particles obtained after the surface treatment had a weight average particle diameter of 5.4 μm, a number average particle diameter of 4.7 μm, and an average circularity of 0.932. A classification yield of the magenta toner particles was 84%.

1.0 part by mass of hydrophobized titanium oxide having a main peak particle diameter of 40 nm and 1.5 parts by mass of amorphous silica having a main peak particle diameter of 110 nm were externally added to and mixed with 100 parts by mass of the resultant magenta toner particles to obtain a magenta toner. The resultant magenta toner had a weight average particle diameter of 5.4 μm, a number average particle diameter of 4.7 μm, an average circularity of 0.932, and a BET specific surface area of 2.80 $m^2/g$. Furthermore, the measured permeability of light of a wavelength of 600 nm in a liquid prepared by dispersing 20 mg of the above magenta toner in a 45 vol % aqueous solution of methanol was 57%. In addition, main peak particle diameters of the inorganic fine particles (the above titanium oxide and amorphous silica) were 40 nm and 110 nm, respectively.

9 parts by mass of the magenta toner and 91 parts by mass of Magnetic Carrier 4 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 16

The pigment of Example 1 was replaced with 6 parts by mass of C.I. Pigment yellow 74, and the other materials were the same as those used in Example 1. Those materials were kneaded and pulverized in the same manner as in Example 1 to obtain finely pulverized products. The resultant finely pulverized products had a weight average particle diameter of 4.8 μm, a number average particle diameter of 3.7 μm, and an average circularity of 0.915.

Next, the resultant finely pulverized products were subjected to surface treatment in the same manner as in Example 1. Yellow toner particles obtained after the surface treatment had a weight average particle diameter of 5.4 μm, a number average particle diameter of 4.5 μm, and an average circularity of 0.932. A classification yield of the yellow toner particles was 85%.

1.0 part by mass of hydrophobized titanium oxide having a main peak particle diameter of 40 nm and 1.5 parts by mass of amorphous silica having a main peak particle diameter of 110 nm were externally added to and mixed with 100 parts by mass of the resultant yellow toner particles to obtain a yellow toner. The resultant yellow toner had a weight average particle diameter of 5.4 μm, a number average particle diameter of 4.6 μm, an average circularity of 0.931, and a BET specific surface area of 2.82 $m^2/g$. Furthermore, the measured permeability of light of a wavelength of 600 nm in a liquid prepared by dispersing 20 mg of the above yellow toner in a 45 vol % aqueous solution of methanol was 56%. In addition, main peak particle diameters of the inorganic fine particles (the above titanium oxide and amorphous silica) were 40 nm and 110 nm, respectively.

9 parts by mass of the yellow toner and 91 parts by mass of Magnetic Carrier 4 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 17

The pigment of Example 1 was replaced with 4 parts by mass of carbon black (Printex 35, manufactured by Degussa) and the other materials were the same as those used in Example 1. Those materials were kneaded and pulverized in the same manner as in Example 1 to obtain finely pulverized products. The resultant finely pulverized products had a weight average particle diameter of 4.5 μm, a number average particle diameter of 3.5 μm, and an average circularity of 0.916.

Next, the resultant finely pulverized products were subjected to surface treatment in the same manner as in Example 1. Black toner particles obtained after the surface treatment had a weight average particle diameter of 5.2 μm, a number average particle diameter of 4.4 μm, and an average circularity of 0.930. A classification yield of the black toner particles was 85%.

1.0 part by mass of hydrophobized titanium oxide having a main peak particle diameter of 40 nm and 1.5 parts by mass of amorphous silica having a main peak particle diameter of 110 nm were externally added to and mixed with 100 parts by mass of the resultant black toner particles to obtain a black toner. The resultant black toner had a weight average particle diameter of 5.3 μm, a number average particle diameter of 4.4 μm, an average circularity of 0.931, and a BET specific surface area of 2.86 $m^2/g$. Furthermore, the measured permeability of light of a wavelength of 600 nm in a liquid prepared by dispersing 20 mg of the above black toner in a 45 vol % aqueous solution of methanol was 52%. In addition, main peak particle diameters of the inorganic fine particles (the above titanium oxide and amorphous silica) were 40 nm and 110 nm, respectively.

9 parts by mass of the black toner and 91 parts by mass of Magnetic Carrier 4 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Example 18

0.5 part by mass of hydrophobized amorphous silica having a main peak particle diameter of 20 nm and 1.5 parts by mass of hydrophobized and oil-treated amorphous silica having a main peak particle diameter of 150 nm were externally added to and mixed with 100 parts by mass of the toner particles used in Example 1 to obtain a cyan toner. The resultant cyan toner had a weight average particle diameter of 5.4 μm, a number average particle diameter of 4.5 μm, an average circularity of 0.935, and a BET specific surface area of 3.47 $m^2/g$. Furthermore, the measured permeability of light of a wavelength of 600 nm in a liquid prepared by dispersing 20 mg of the above cyan toner in a 45 vol % aqueous solution of methanol was 59%. In addition, main peak diameters of the inorganic fine particles on the surface of the toner were 20 nm and 150 nm, respectively.

Image output evaluation was carried out under normal temperature and normal humidity (23° C., 60% RH) by using the toner and a remodeled device of a laser-beam printer LBP-2030 manufactured by Canon (obtained by replacing a fixing roller with a silicone tube in the same manner as in Example 1 and by removing an oil application mechanism). A test was performed in the same manner as in Example 1. Table 3 shows the prescription of the toner particles used. Table 4 shows the physical properties of the toner particles. Table 5 shows the test results.

Scattering was at a practically acceptable level. Although charge up occurred during the prolonged use to result in slight deteriorations in dot reproducibility and developability, both the dot reproducibility and developability were at practically acceptable levels.

Comparative Example 1

Wax A of Example 1 was replaced with Wax E, and the other materials were the same as those used in Example 1. Those materials were kneaded and pulverized in the same manner as in Example 1 to obtain finely pulverized products. The resultant finely pulverized products had a weight average particle diameter of 5.8 μm, a number average particle diameter of 4.3 μm, and an average circularity of 0.912.

Next, the finely pulverized products were subjected to classifying treatment by using a multi-division classifier. Cyan toner particles obtained after the classifying treatment had a weight average particle diameter of 6.5 μm, a number average particle diameter of 5.5 μm, and an average circularity of 0.912. A classification yield of the cyan toner particles was 77%. 0.8 part by mass of hydrophobized titanium oxide having a main peak particle diameter of 40 nm and 1.5 parts by mass of amorphous silica having a main peak particle diameter of 110 nm were externally added to and mixed with 100 parts by mass of the resultant cyan toner particles to obtain a cyan toner. The resultant cyan toner had a weight average particle diameter of 6.5 μm, a number average particle diameter of 5.5 μm, an average circularity of 0.912, and a BET specific surface area of 3.07 $m^2/g$. Furthermore, the measured permeability of light of a wavelength of 600 nm in a liquid prepared by dispersing 20 mg of the above cyan toner in a 45 vol % aqueous solution of methanol was 15%. In addition, main peak particle diameters of the inorganic fine particles (the above titanium oxide and amorphous silica) were 40 nm and 110 nm, respectively.

7 parts by mass of the cyan toner and 93 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

The developer was excellent in developability but poor in low temperature fixability, thereby resulting in only an image with a low gloss. Furthermore, the developer was slightly poor in dot reproducibility and some degree of scattering was observed.

Comparative Example 2

Wax A of Example 1 was replaced with Wax F, and the other materials were the same as those used in Example 1. Those materials were kneaded and pulverized in the same manner as in Example 1 to obtain finely pulverized products. The resultant finely pulverized products had a weight average particle diameter of 4.3 μm, a number average particle diameter of 3.2 μm, and an average circularity of 0.916.

Next, the finely pulverized products were subjected to surface treatment in the same manner as in Example 1. Cyan toner particles obtained after the surface treatment had a weight average particle diameter of 5.3 μm, a number average particle diameter of 4.4 μm, and an average circularity of 0.935. A classification yield of the cyan toner particles was 69%.

1.0 part by mass of hydrophobized titanium oxide having a main peak particle diameter of 40 nm and 1.5 parts by mass of amorphous silica having a main peak particle diameter of 110 nm were externally added to and mixed with 100 parts by mass of the resultant cyan toner particles to obtain a cyan toner. The resultant cyan toner had a weight average particle diameter of 5.3 μm, a number average particle diameter of 4.4 μm, an average circularity of 0.935, and a BET specific surface area of 2.85 $m^2/g$. Furthermore, the measured permeability of light of a wavelength of 600 nm in a liquid prepared by dispersing 20 mg of the above cyan toner in a 45 vol % aqueous solution of methanol was 83%. In addition, main peak particle diameters of the inorganic fine particles (the above titanium oxide and amorphous silica) were 40 nm and 110 nm, respectively.

7 parts by mass of the cyan toner and 93 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

Although the developer was excellent in low temperature fixability, the developer caused carrier contamination over prolonged use and showed a reduction in charge amount. As a result, its developability changed from that at an early stage.

Comparative Example 3

Hybrid resin of Example 1 was replaced with Styrene-acrylic resin, and the other materials were the same as those used in Example 1. Those materials were kneaded and pulverized in the same manner as in Example 1 to obtain finely pulverized products. The resultant finely pulverized products had a weight average particle diameter of 5.6 μm, a number average particle diameter of 4.3 μm, and an average circularity of 0.912.

Next, the finely pulverized products were subjected to surface treatment in the same manner as in Example 1. Cyan toner particles obtained after the surface treatment had a weight average particle diameter of 6.6 μm, a number average particle diameter of 5.4 μm, and an average circularity of 0.921. A classification yield of the cyan toner particles was 76%.

0.8 part by mass of hydrophobized titanium oxide having a main peak particle diameter of 40 nm and 1.5 parts by mass of amorphous silica having a main peak particle diameter of 110 nm were externally added to and mixed with 100 parts by mass of the resultant cyan toner particles to obtain a cyan toner. The resultant cyan toner had a weight average particle diameter of 6.6 μm, a number average particle diameter of 5.4 μm, an average circularity of 0.922, and a BET specific surface area of 2.07 $m^2/g$. Furthermore, the measured permeability of light of a wavelength of 600 nm in a liquid prepared by dispersing 20 mg of the above cyan toner in a 45 vol % aqueous solution of methanol was 28%. In addition, main peak particle diameters of the inorganic fine particles (the above titanium oxide and amorphous silica) were 40 nm and 110 nm, respectively.

7 parts by mass of the cyan toner and 93 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

The developer was excellent in early-stage developability but scattering during transfer was observed. Moreover, the developer had bad low temperature fixability and was poor in hot offset resistance, so that the resultant image had a low gloss.

Comparative Example 4

Cyan toner particles were obtained in the same manner as in Example 1 except that the roughly pulverized products obtained in Example 1 were finely pulverized by using Super Rotor (manufactured by Nisshin Engineering Inc.) instead of the collision type air-jet pulverizer and the surface modifying apparatus as shown in FIG. 1 and that the finely pulverized products were classified by using a multidivision classifier. The resultant cyan toner particles had a weight average particle diameter of 6.6 μm, a number average particle diameter of 5.3 μm, and an average circularity of 0.922.

0.8 part by mass of hydrophobized titanium oxide having a main peak particle diameter of 40 nm and 1.5 parts by mass of amorphous silica having a main peak particle diameter of 110 nm were externally added to and mixed with 100 parts by mass of the resultant cyan toner particles to obtain a cyan toner. The resultant cyan toner had a weight average particle diameter of 6.6 μm, a number average particle diameter of 5.3 μm, an average circularity of 0.922, and a BET specific surface area of 2.00 $m^2/g$. Furthermore, the measured permeability of light of a wavelength of 600 nm in a liquid prepared by dispersing 20 mg of the above cyan toner in a 45 vol % aqueous solution of methanol was 81%. In addition, main peak particle diameters of the inorganic fine particles (the above titanium oxide and amorphous silica) were 40 nm and 110 nm, respectively.

7 parts by mass of the cyan toner and 93 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

The developer was poor in fine dot reproducibility. Moreover, the developer was poor in transferability from an early stage. Therefore, carrier contamination gradually proceeded over prolonged use, and a change in developability was observed.

Comparative Example 5

Cyan toner particles were obtained in the same manner as in Example 1 except that the finely pulverized products obtained in Example 1 were classified by using a multidivision classifier instead of the surface modifying apparatus as shown in FIG. 1 and were sphered with a hot air stream by using Therfusing System (manufactured by Nippon Pneumatic Mfg. Co., Ltd.). The resultant cyan toner particles had a weight average particle diameter of 5.4 μm, a number average particle diameter of 4.7 μm, and an average circularity of 0.963.

1.0 part by mass of hydrophobized titanium oxide having a main peak particle diameter of 40 nm and 1.5 parts by mass of amorphous silica having a main peak particle diameter of 110 nm were externally added to and mixed with 100 parts by mass of the resultant toner particles to obtain a cyan toner. The resultant cyan toner had a weight average particle diameter of 5.4 μm, a number average particle diameter of 4.7 μm, an average circularity of 0.963, and a BET specific surface area of 2.33 $m^2/g$. Furthermore, the measured permeability of light of a wavelength of 600 nm in a liquid prepared by dispersing 20 mg of the above cyan toner in a 45 vol % aqueous solution of methanol was 89%. In addition, main peak particle diameters of the inorganic fine particles (the above titanium oxide and amorphous silica) were 40 nm and 110 nm, respectively.

7 parts by mass of the cyan toner and 93 parts by mass of Magnetic Carrier 1 were mixed in a turbler mixer to prepare a developer. A test was performed with the developer in the same manner as in Example 1. Table 3 shows the prescription of the toner used. Table 4 shows the physical properties of the toner and magnetic carrier. Table 5 shows the test results of the developer.

The developer had extremely high early-stage transferability and was excellent in low temperature fixability. However, toner spent to a magnetic carrier was severe and a change in developability occurred at an early time of prolonged use. In addition, a reduction in transferability and contamination of a developing sleeve due to prolonged use was observed.

TABLE 3-1

| | | | | Pulverization Condition | | | |
|---|---|---|---|---|---|---|---|
| | Binder Resin | Releasing Agent | Colorant | Method for producing | Classifying Rotor (rpm) | Dispersing Rotor (rpm) | Surface Treatment Time Period (sec/time) |
| Example 1 | Hybrid Resin | Wax A | C. I. Pig. Blue 15:3 | jet + Surface Modifying (FIG. 1) | 7300 | 5800 | 70 |
| Example 2 | Hybrid Resin | Wax A | C. I. Pig. Blue 15:3 | jet + Surface Modifying (FIG. 1) | 6800 | 5800 | 70 |
| Example 3 | Hybrid Resin | Wax A | C. I. Pig. Blue 15:3 | jet + Surface Modifying (FIG. 1) | 7800 | 5800 | 70 |
| Example 4 | Hybrid Resin | Wax A | C. I. Pig. Blue 15:3 | jet + Surface Modifying (FIG. 1) | 7300 | 4500 | 45 |
| Example 5 | Hybrid Resin | Wax A | C. I. Pig. Blue 15:3 | jet + Surface Modifying (FIG. 1) | 7300 | 6500 | 70 |
| Example 6 | Hybrid Resin | Wax A | C. I. Pig. Blue 15:3 | jet + Surface Modifying (FIG. 1) | 7300 | 5800 | 70 |

TABLE 3-1-continued

| | Binder Resin | Releasing Agent | Colorant | Pulverization Condition: Method for producing | Classifying Rotor (rpm) | Dispersing Rotor (rpm) | Surface Treatment Time Period (sec/time) |
|---|---|---|---|---|---|---|---|
| Example 7 | Hybrid Resin | Wax B | C. I. Pig. Blue 15:3 | jet + Surface Modifying (FIG. 1) | 7300 | 5800 | 70 |
| Example 8 | Hybrid Resin | Wax C | C. I. Pig. Blue 15:3 | jet + Surface Modifying (FIG. 1) | 7300 | 5800 | 70 |
| Example 9 | Hybrid Resin | Wax D | C. I. Pig. Blue 15:3 | jet + Surface Modifying (FIG. 1) | 7300 | 5800 | 70 |
| Example 10 | Polyester Resin | Wax A | C. I. Pig. Blue 15:3 | jet + Surface Modifying (FIG. 1) | 7300 | 5800 | 70 |
| Example 11 | Hybrid Resin | Wax A | C. I. Pig. Blue 15:3 | jet + Surface Modifying (FIG. 1) | 7300 | 5800 | 70 |
| Example 12 | Hybrid Resin | Wax A | C. I. Pig. Blue 15:3 | jet + Surface Modifying (FIG. 1) | 7300 | 5800 | 70 |
| Example 13 | Hybrid Resin | Wax A | C. I. Pig. Blue 15:3 | jet + Surface Modifying (FIG. 1) | 7300 | 5800 | 70 |
| Example 14 | Hybrid Resin | Wax A | C. I. Pig. Blue 15:3 | jet + Surface Modifying (FIG. 1) | 7300 | 5800 | 70 |
| Example 15 | Hybrid Resin | Wax A | C. I. Pig. Red 122<br>C. I. Pig. Red 57 | jet + Surface Modifying (FIG. 1) | 7300 | 5800 | 70 |
| Example 16 | Hybrid Resin | Wax A | C. I. Pig. Yellow 74 | jet + Surface Modifying (FIG. 1) | 7300 | 5800 | 70 |
| Example 17 | Hybrid Resin | Wax A | Carbon Black | jet + Surface Modifying (FIG. 1) | 7300 | 5800 | 70 |
| Example 18 | Hybrid Resin | Wax A | C. I. Pig. Blue 15:3 | jet + Surface Modifying (FIG. 1) | 7300 | 5800 | 70 |

TABLE 3-2

| | Binder Resin | Releasing Agent | Colorant | Pulverization Condition: Method for producing | Classifying Rotor (rpm) | Dispersing Rotor (rpm) | Surface Treatment Time Period (sec/time) |
|---|---|---|---|---|---|---|---|
| Comparative Example 1 | Hybrid Resin | Wax E | C. I. Pig. Blue 15:3 | jet + Multidivision Classification | — | — | — |
| Comparative Example 2 | Hybrid Resin | Wax F | C. I. Pig. Blue 15:3 | jet + Surface Modifying (FIG. 1) | 7300 | 5800 | 70 |
| Comparative Example 3 | Styrene-Acrylic Resin | Wax A | C. I. Pig. Blue 15:3 | jet + Surface Modifying (FIG. 1) | 7300 | 5800 | 70 |
| Camparative Example 4 | Hybrid Resin | Wax A | C. I. Pig. Blue 15:3 | Super Rotor + Multidivision Classification | — | — | — |
| Comparative Example 5 | Hybrid Resin | Wax A | C. I. Pig. Blue 15:3 | jet + Multidivision Classification + Therfusion | — | — | — |

TABLE 3-3

| | Inorganic Fine Particle: Kind | Main Peak Particle Diameter (nm) | Addition Amount (Part by Mass) |
|---|---|---|---|
| Example 1 | $TiO_2/SiO_2$ | 40/110 | 1.0/1.5 |
| Example 2 | $Al_2O_3/SiO_2$ | 60/90 | 0.8/1.2 |
| Example 3 | $TiO_2/SiO_2$ | 30/110 | 1.3/2.5 |
| Example 4 | $SiO_2/Al_2O_3$ | 20/90 | 0.9/1.5 |
| Example 5 | $TiO_2/SiO_2$ | 40/110 | 0.8/1.5 |
| Example 6 | $SiO_2/SiO_2$ | 30/90 | 1.0/2.0 |
| Example 7 | $TiO_2/SiO_2$ | 40/110 | 1.0/1.5 |
| Example 8 | $TiO_2/SiO_2$ | 40/110 | 1.0/1.5 |
| Example 9 | $TiO_2/SiO_2$ | 40/110 | 1.0/1.5 |
| Example 10 | $TiO_2/SiO_2$ | 40/110 | 1.0/1.5 |
| Example 11 | $TiO_2/SiO_2$ | 40/110 | 1.0/1.5 |
| Example 12 | $TiO_2/SiO_2$ | 40/110 | 1.0/1.5 |
| Example 13 | $TiO_2/SiO_2$ | 40/110 | 1.0/1.5 |
| Example 14 | $TiO_2/SiO_2$ | 40/110 | 1.0/1.5 |
| Example 15 | $TiO_2/SiO_2$ | 40/110 | 1.0/1.5 |
| Example 16 | $TiO_2/SiO_2$ | 40/110 | 1.0/1.5 |
| Example 17 | $TiO_2/SiO_2$ | 40/110 | 1.0/1.5 |
| Example 18 | $SiO_2/SiO_2$ | 20/150 | 0.5/1.5 |

TABLE 3-3-continued

| | Inorganic Fine Particle: Kind | Main Peak Particle Diameter (nm) | Addition Amount (Part by Mass) |
|---|---|---|---|
| Comparative Example 1 | $TiO_2/SiO_2$ | 40/110 | 0.8/1.5 |
| Comparative Example 2 | $TiO_2/SiO_2$ | 40/110 | 1.0/1.5 |
| Comparative Example 3 | $TiO_2/SiO_2$ | 40/110 | 0.8/1.5 |
| Comparative Example 4 | $TiO_2/SiO_2$ | 40/110 | 0.8/1.5 |
| Comparative Example 5 | $TiO_2/SiO_2$ | 40/110 | 1.0/1.5 |

TABLE 4-1

| | Toner | | | | | |
|---|---|---|---|---|---|---|
| | Weight Average Particle Diameter (μm) | Number Average Particle Diameter (μm) | Average Circularity (−) | Permeability (%) | BET Specific Surface Area ($m^2/g$) | Largest Endothermic Peak (° C.) |
| Example 1 | 5.4 | 4.9 | 0.935 | 62 | 2.80 | 85 |
| Example 2 | 6.2 | 5.5 | 0.932 | 54 | 2.10 | 85 |
| Example 3 | 3.3 | 2.6 | 0.931 | 76 | 3.49 | 85 |
| Example 4 | 5.4 | 4.8 | 0.921 | 36 | 2.98 | 85 |
| Example 5 | 5.4 | 4.5 | 0.944 | 79 | 2.30 | 85 |
| Example 6 | 5.4 | 4.5 | 0.934 | 59 | 3.40 | 85 |
| Example 7 | 5.4 | 4.8 | 0.930 | 70 | 2.76 | 66 |
| Example 8 | 5.4 | 4.7 | 0.933 | 54 | 2.73 | 77 |
| Example 9 | 5.7 | 5.1 | 0.926 | 42 | 2.60 | 107 |
| Example 10 | 5.7 | 4.9 | 0.930 | 40 | 2.77 | 84 |
| Example 11 | 5.4 | 4.9 | 0.935 | 62 | 2.80 | 85 |
| Example 12 | 5.4 | 4.9 | 0.935 | 62 | 2.80 | 85 |
| Example 13 | 5.4 | 4.9 | 0.935 | 62 | 2.80 | 85 |
| Example 14 | 5.4 | 4.9 | 0.935 | 62 | 2.80 | 85 |
| Example 15 | 5.4 | 4.7 | 0.932 | 57 | 2.80 | 86 |
| Example 16 | 5.4 | 4.6 | 0.931 | 56 | 2.82 | 85 |
| Example 17 | 5.3 | 4.4 | 0.931 | 52 | 2.86 | 86 |
| Example 18 | 5.4 | 4.5 | 0.935 | 59 | 3.47 | 85 |

TABLE 4-2

| | Toner | | | | | |
|---|---|---|---|---|---|---|
| | Weight Average Particle Diameter (μm) | Number Average Particle Diameter (μm) | Average Circularity (−) | Permeability (%) | BET Specific Surface Area ($m^2/g$) | Largest Endothermic Peak (° C.) |
| Comparative Example 1 | 6.5 | 5.5 | 0.912 | 15 | 3.07 | 113 |
| Comparative Example 2 | 5.3 | 4.4 | 0.935 | 83 | 2.85 | 61 |
| Comparative Example 3 | 6.6 | 5.4 | 0.922 | 28 | 2.07 | 84 |
| Comparative Example 4 | 6.6 | 5.3 | 0.922 | 81 | 2.00 | 85 |
| Comparative Example 5 | 5.4 | 4.7 | 0.963 | 89 | 2.33 | 85 |

TABLE 4-3

| | Carrier | | | | |
|---|---|---|---|---|---|
| | Kind | Number Average Particle Diameter (μm) | True Specific Gravity ($g/cm^3$) | Intensity of Magnetization ($kAm^2/m^3$) | Kind of Coating Material |
| Example 1 | Carrier 1 | 52 | 5.02 | 301 | Silicone Resin |
| Example 2 | Carrier 1 | 52 | 5.02 | 301 | Silicone Resin |
| Example 3 | Carrier 1 | 52 | 5.02 | 301 | Silicone Resin |
| Example 4 | Carrier 1 | 52 | 5.02 | 301 | Silicone Resin |
| Example 5 | Carrier 1 | 52 | 5.02 | 301 | Silicone Resin |
| Example 6 | Carrier 1 | 52 | 5.02 | 301 | Silicone Resin |
| Example 7 | Carrier 1 | 52 | 5.02 | 301 | Silicone Resin |
| Example 8 | Carrier 1 | 52 | 5.02 | 301 | Silicone Resin |
| Example 9 | Carrier 1 | 52 | 5.02 | 301 | Silicone Resin |
| Example 10 | Carrier 1 | 52 | 5.02 | 301 | Silicone Resin |
| Example 11 | Carrier 2 | 32 | 3.55 | 189 | Silicone Resin |
| Example 12 | Carrier 3 | 32 | 3.53 | 186 | Fluororesin(m = 7, n = 2) |
| Example 13 | Carrier 4 | 33 | 3.53 | 185 | Fluororesin(m = 7, n = 2), Melamine Resin, Carbon Particle |
| Example 14 | Carrier 5 | 28 | 3.51 | 131 | Silicone Resin, Tin Oxide particle |
| Example 15 | Carrier 4 | 33 | 3.53 | 185 | Fluororesin(m = 7, n = 2), Melamine Resin, Carbon Particle |
| Example 16 | Carrier 4 | 33 | 3.53 | 185 | Fluororesin(m = 7, n = 2), Melamine Resin, Carbon Particle |
| Example 17 | Carrier 4 | 33 | 3.53 | 185 | Fluororesin(m = 7, n = 2), Melamine Resin, Carbon Particle |
| Example 18 | — | — | — | — | — |

TABLE 4-4

| | Carrier | | | | |
|---|---|---|---|---|---|
| | Kind | Number Average Particle Diameter (μm) | True Specific Gravity ($g/cm^3$) | Intensity of Magnetization ($kAm^2/m^3$) | Kind of Coating Material |
| Comparative Example 1 | Carrier 1 | 52 | 5.02 | 301 | Silicone Resin |
| Comparative Example 2 | Carrier 1 | 52 | 5.02 | 301 | Silicone Resin |
| Comparative Example 3 | Carrier 1 | 52 | 5.02 | 301 | Silicone Resin |
| Comparative Example 4 | Carrier 1 | 52 | 5.02 | 301 | Silicone Resin |
| Comparative Example 5 | Carrier 1 | 52 | 5.02 | 301 | Silicone Resin |

TABLE 5-1

| | Early Stage | | | | | | | |
|---|---|---|---|---|---|---|---|---|
| | Dot Reproducibility | Scattering | Image Density (−) | Gloss (−) | Charge Amount (mC/kg) | Developability (Vcont) | Transfer Efficiency (%) | Fixing Range (° C.) |
| Example 1 | B | B | 1.65 | 24 | −38.1 | 290 | 96 | 130–200 |
| Example 2 | B | C | 1.66 | 26 | −30.4 | 260 | 97 | 130–200 |
| Example 3 | A | B | 1.69 | 28 | −51.6 | 430 | 94 | 140–200 |
| Example 4 | B | B | 1.65 | 23 | −39.0 | 300 | 93 | 140–200 |
| Example 5 | B | B | 1.71 | 32 | −38.0 | 295 | 98 | 120–190 |
| Example 6 | B | B | 1.67 | 25 | −38.8 | 300 | 97 | 140–200 |
| Example 7 | B | B | 1.73 | 34 | −37.6 | 300 | 96 | 120–190 |
| Example 8 | B | B | 1.70 | 29 | −38.2 | 300 | 97 | 120–200 |
| Example 9 | B | B | 1.59 | 18 | −39.4 | 300 | 95 | 150–200 |
| Example 10 | B | B | 1.60 | 20 | −39.8 | 305 | 96 | 140–200 |
| Example 11 | A | A | 1.67 | 25 | −46.2 | 280 | 97 | 130–200 |
| Example 12 | A | A | 1.68 | 26 | −50.8 | 280 | 98 | 130–200 |
| Example 13 | A | A | 1.68 | 25 | −36.4 | 290 | 97 | 130–200 |
| Example 14 | A | B | 1.65 | 24 | −38.7 | 290 | 96 | 130–200 |
| Example 15 | A | A | 1.60 | 23 | −39.5 | 300 | 97 | 130–200 |
| Example 16 | A | A | 1.63 | 24 | −40.3 | 310 | 97 | 130–200 |
| Example 17 | A | B | 1.64 | 24 | −37.0 | 295 | 97 | 130–200 |
| Example 18 | B | C | 1.50 | 25 | −42.6 | 320 | 96 | 130–200 |

TABLE 5-2

| | Early Stage | | | | | | | |
|---|---|---|---|---|---|---|---|---|
| | Dot Reproducibility | Scattering | Image Density (−) | Gloss (−) | Charge Amount (mC/kg) | Developability (Vcont) | Transfer Efficiency (%) | Fixing Range (° C.) |
| Comparative Example 1 | C | C | 1.52 | 12 | −39.6 | 310 | 90 | 160–200 |
| Comparative Example 2 | C | B | 1.72 | 33 | −38.0 | 300 | 96 | 120–190 |
| Comparative Example 3 | B | B | 1.55 | 15 | −38.7 | 300 | 94 | 150–190 |
| Comparative Example 4 | C | B | 1.68 | 29 | −39.9 | 310 | 94 | 130–190 |
| Comparative Example 5 | B | C | 1.70 | 30 | −37.2 | 295 | 98 | 120–190 |

TABLE 5-3

| | After Printing 10,000 Sheets | | | | |
|---|---|---|---|---|---|
| | Dot Reproducibility | Scattering | Charge Amount (mC/kg) | Developability (Vcont) | Transfer Efficiency (%) |
| Example 1 | C | B | −37.0 | 285 | 95 |
| Example 2 | C | C | −28.4 | 240 | 94 |
| Example 3 | C | C | −47.8 | 410 | 90 |
| Example 4 | C | C | −36.5 | 285 | 91 |
| Example 5 | C | C | −35.8 | 275 | 93 |
| Example 6 | B | C | −35.1 | 285 | 94 |
| Example 7 | C | C | −34.2 | 280 | 93 |
| Example 8 | C | B | −35.1 | 290 | 95 |
| Example 9 | C | B | −38.5 | 290 | 93 |
| Example 10 | C | B | −37.2 | 280 | 93 |
| Example 11 | B | B | −45.0 | 270 | 95 |
| Example 12 | A | B | −50.0 | 280 | 98 |
| Example 13 | A | A | −35.0 | 275 | 96 |
| Example 14 | B | B | −37.0 | 285 | 95 |
| Example 15 | A | A | −38.9 | 300 | 97 |
| Example 16 | A | A | −39.8 | 305 | 97 |
| Example 17 | A | B | −36.2 | 295 | 97 |
| Example 18 | C | C | −49.0 | 360 | 91 |
| Comparative Example 1 | D | D | −34.1 | 280 | 88 |
| Comparative Example 2 | E | D | −24.2 | 205 | 85 |
| Comparative Example 3 | C | D | −30.3 | 240 | 90 |
| Comparative Example 4 | C | D | −29.7 | 240 | 88 |
| Comparative Example 5 | D | E | −25.1 | 210 | 87 |

What is claimed is:

1. A toner comprising toner particles each comprising at least a binder resin, a colorant, and a releasing agent, and inorganic fine particles, wherein:

the binder resin comprises at least a polyester unit;

a weight average particle diameter of the toner is in a range of 3.0 to 6.5 μn;

an average circularity of particles in the toner each having a circle-equivalent diameter of 2 μn or more is in a range of 0.920 to 0.945;

a BET specific surface area of the toner is in a range of 2.1 to 3.5 $m^2/g$; and a permeability of light of a wavelength of 600 nm in a liquid prepared by dispersing the toner in a 45 vol % aqueous solution of methanol is in a range of 30 to 80%.

2. The toner according to claim 1, wherein the inorganic fine particles are externally added to the toner particles, and a main peak particle diameter of the inorganic fine particles determined on the basis of the greatest frequency in a particle size distribution of the inorganic fine particles is in a range of 80 to 200 nm.

3. The toner according to claim 2, further comprising fine particles to be externally added to the toner particles, and main peak particle diameter of the fine particles determined on the basis of the greatest frequency in a particle size distribution of the fine particles is in a range of 10 to 70 nm.

4. The toner according to claim 1, wherein the binder resin is a resin selected from the group consisting of:

(a) a polyester resin;

(b) a hybrid resin comprising a polyester unit and a vinyl-based polymer unit;

(c) a mixture of a hybrid resin and a vinyl-based polymer, the hybrid resin comprising a polyester unit and a vinyl-based polymer unit;

(d) a mixture of a polyester resin and a vinyl-based polymer;

(e) a mixture of a hybrid resin and a polyester resin, the hybrid resin comprising a polyester unit and a vinyl-based polymer unit; and (f) a mixture of a polyester resin, a hybrid resin, and a vinyl-based polymer, the hybrid resin comprising a polyester unit and a vinyl-based polymer unit.

5. The toner according to claim 1, wherein:

the releasing agent is a hydrocarbon-based wax; and the toner has one or two or more endothermic peaks in a temperature range of 30 to 200° C. in an endothermic curve obtained through differential scanning calorimetry of the toner, and a temperature of the largest endothermic peak of the endothermic peaks is in a range of 65 to 110° C.

6. The toner according to claim 1, wherein the toner particles comprise a metal compound of aromatic carboxylic acid.

7. The toner according to claim 1, wherein:

the toner particles are toner particles sphered by a surface modifying apparatus;

the surface modifying apparatus comprises:

a classifying means for classifying the toner particles into particles each having a predetermined particle diameter and fine particles each having a particle diameter less than the predetermined particle diameter;

a surface treatment means for treating surfaces of particles to be introduced by applying a mechanical impact to the particles to be introduced;

a guide means for guiding the particles each having the predetermined particle diameter classified by the classifying means to the surface treatment means;

a discharging means for discharging the fine particles each having a particle diameter less than the predetermined particle diameter classified by the classifying means to an outside of the surface modifying apparatus; and a particle circulation means for sending the particles having their surfaces treated by the surface treatment means to the classifying means; and the surface modifying apparatus is an apparatus which is capable of repeating particle classification with the classifying means and particle surface treatment with the surface treatment means for a predetermined time.

8. The toner according to claim 1, wherein the inorganic particles are one or two or more kinds selected from the group consisting of titanium oxide, alumina, and silica.

9. A two-component developer comprising a toner and a magnetic carrier, wherein:

the toner comprises toner particles each comprising at least a binder resin, a colorant, and a releasing agent, and inorganic fine particles;

the binder resin comprises at least a polyester unit;

a weight average particle diameter of the toner is in a range of 3.0 to 6.5 μm;

an average circularity of particles in the toner each having a circle-equivalent diameter of 2 μm or more is in a range of 0.920 to 0.945;

a BET specific surface area of the toner is in a range of 2.1 to 3.5 $m^2/g$;

a permeability of light of a wavelength of 600 nm in a liquid prepared by dispersing the toner in a 45 vol % aqueous solution of methanol is in a range of 30 to 80%; and the magnetic carrier comprises: magnetic core particles comprising a magnetic material; and a coating layer formed on surfaces of the magnetic core particles by using a resin, and a number average particle diameter of the magnetic carrier is in a range of 15 to 80μm.

10. The two-component developer according to claim 9, wherein the magnetic carrier is a magnetic material-dispersion type core particle in which the magnetic material is held by the binding resin in a dispersed state, and an intensity of magnetization of the magnetic carrier in 79.6 kA/m is in a range of 50 to 220 $kAm^2/m^3$.

11. The two-component developer according to claim 9, wherein the coating layer is a layer formed from a resin comprising a polymer that has a fluorine atom.

12. The two-component developer according to any one of claims 9 to 11, wherein the coating layer is a layer formed from a resin comprising one of an acrylate perfluoroalkyl polymer that has a perfluorinated alkyl unit and a methacrylate perfluoroalkyl polymer that has a perfluorinated alkyl unit.

13. The two-component developer according to claim 9, wherein the coating layer is a layer formed from one of a polymer of a (meth)acrylate having a perfluorinated alkyl unit that is represented by the following formula (4) and a copolymer of the (meth)acrylate having the perfluorinated alkyl unit that is represented by the following formula (4) and another monomer:

$$CF_3-(CF_2)_m- \quad (4)$$

(In the formula, m denotes an integer of 4 to 8).

14. The two-component developer according to claim 9, wherein the coating layer comprises particles each having electric conductivity, and wherein the particles each having electric conductivity has a number average particle diameter of 1 μm or less and a specific resistance of $1\times10^8$ Ωcm or less.

15. The two-component developer according to claim 14, wherein the particles each having electric conductivity are one or two or more kinds of particles selected from the group consisting of carbon black, magnetite, graphite, titanium oxide, alumina, zinc oxide, and tin oxide.

16. The two-component developer according to claim 9, wherein the coating layer comprises particles each having charge controllability, and a number average particle diameter of the particles each having charge controllability is in a range of 0.01 to 1.5 μm.

17. The two-component developer according to claim 16, wherein the particles each having charge controllability are one or two or more kinds of particles selected from the group consisting of a polymethyl methacrylate resin, a polystyrene resin, a melamine resin, a phenol resin, a nylon resin, silica, titanium oxide, and alumina.

* * * * *

UNITED STATES PATENT AND TRADEMARK OFFICE

CERTIFICATE OF CORRECTION

PATENT NO. : 7,144,668 B2
APPLICATION NO. : 10/792732
DATED : December 5, 2006
INVENTOR(S) : Yoshinobu Baba et al.

It is certified that error appears in the above-identified patent and that said Letters Patent is hereby corrected as shown below:

COLUMN 6:

Line 64, "ABET" should read --A BET--.

COLUMN 8:

Line 58, "Apolyester" should read --A polyester--.

COLUMN 29:

Line 17, "β-styragel" should read --μ-styragel--.

COLUMN 34:

Line 16, "1x10-2" should read --$1x10^{-2}$--.

COLUMN 47:

Line 39, "0.8 part" should read --¶ 0.8 part--.

COLUMN 57:

Claim 1
Line 40, "6.5μn;" should read --6.5μm;--; and
Line 52, "2μn" should read --2μm--.

Signed and Sealed this

Twenty-sixth Day of June, 2007

JON W. DUDAS
*Director of the United States Patent and Trademark Office*